US010025264B1

(12) United States Patent
Itabashi

(10) Patent No.: US 10,025,264 B1
(45) Date of Patent: Jul. 17, 2018

(54) DEVELOPING CARTRIDGE INCLUDING STORAGE MEDIUM HAVING ELECTRIC CONTACT SURFACE

(71) Applicant: BROTHER KOGYO KABUSHIKI KAISHA, Nagoya-shi, Aichi-ken (JP)

(72) Inventor: Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,754

(22) Filed: Sep. 29, 2017

(30) Foreign Application Priority Data

Mar. 30, 2017 (JP) ..... 2017-067271

(51) Int. Cl.
*G03G 15/08* (2006.01)
*G03G 21/16* (2006.01)

(52) U.S. Cl.
CPC ..... *G03G 21/1652* (2013.01); *G03G 15/0863* (2013.01); *G03G 15/0865* (2013.01); *G03G 21/1647* (2013.01)

(58) Field of Classification Search
CPC ..... G03G 15/0863; G03G 15/0865; G03G 21/1647; G03G 21/1652; G03G 21/1676; G03G 21/1867; G03G 21/1875; G03G 21/1878; G03G 2215/0695; G03G 2221/163; G03G 2221/1823
See application file for complete search history.

(56) References Cited

U.S. PATENT DOCUMENTS 8,660,453 B2 * 2/2014 Oda ..... G03G 21/1652 399/90
2006/0062589 A1 3/2006 Sasaki et al.
2009/0003875 A1 1/2009 Toba et al.
2010/0080615 A1 4/2010 Kikuchi
(Continued)

FOREIGN PATENT DOCUMENTS

JP 2008-242085 A 10/2008
JP 2009-31376 A 2/2009
(Continued)

OTHER PUBLICATIONS

International Search Report and Written Opinion issued in related International Application No. PCT/JP2017/035406, dated Nov. 28, 2017.
(Continued)

*Primary Examiner* — Sophia S Chen
(74) *Attorney, Agent, or Firm* — Merchant & Gould P.C.

(57) ABSTRACT

A developing roller rotatable about a first axis extending in a first direction is positioned at one end portion of a casing of a developing cartridge in a second direction. A holder, movable relative to the casing between first and second positions in a third direction crossing an electric contact surface of a storage medium, has one end portion, in the third direction, that holds the electric contact surface. A first lever is movable relative to the casing between third and fourth positions about a second axis extending in the first direction. A second lever movable together with the holder is movable between fifth and sixth positions relative to the first lever. The holder is at the first position in a case where the second lever is at the fifth position, and is at the second position in a case where the second lever is at the sixth position.

21 Claims, 19 Drawing Sheets

(56) References Cited

U.S. PATENT DOCUMENTS

| | | | | |
|---|---|---|---|---|
| 2011/0064451 | A1 | 3/2011 | Okabe et al. | |
| 2011/0129252 | A1 | 6/2011 | Oda et al. | |
| 2012/0121292 | A1 | 5/2012 | Okabe | |
| 2013/0051849 | A1 | 2/2013 | Itabashi et al. | |
| 2015/0037059 | A1 | 2/2015 | Yang et al. | |
| 2015/0261177 | A1 | 9/2015 | Moon et al. | |
| 2016/0349697 | A1 | 12/2016 | Wei et al. | |
| 2016/0357126 | A1* | 12/2016 | Kim | G03G 15/0863 |

FOREIGN PATENT DOCUMENTS

| | | | |
|---|---|---|---|
| JP | 2009-251201 | A | 10/2009 |
| JP | 2011-59510 | A | 3/2011 |
| JP | 2011-118119 | A | 6/2011 |
| JP | 2013-54058 | A | 3/2013 |
| JP | 3196279 | U | 3/2015 |

OTHER PUBLICATIONS

Extended European Search Report issued in corresponding European Patent Application 17193931.7, dated Feb. 13, 2018.

* cited by examiner

DEVELOPING CARTRIDGE INCLUDING STORAGE MEDIUM HAVING ELECTRIC CONTACT SURFACE

CROSS REFERENCE TO RELATED APPLICATION

This application claims priority from Japanese Patent Application No. 2017-067271 filed Mar. 30, 2017. The entire content of the priority application is incorporated herein by reference.

TECHNICAL FIELD

The present disclosure relates to a developing cartridge.

BACKGROUND

There is known an electrophotographic image forming apparatus such as a laser printer and an LED printer. Such an image forming apparatus uses a developing cartridge. The developing cartridge includes a developing roller for supplying toner.

Prior art discloses a developing cartridge of a type that is inserted into a drawer unit. The drawer unit includes photosensitive drums. When a plurality of the developing cartridges are inserted into the drawer unit, the developing cartridges face the photosensitive drums, respectively. Then, the drawer unit attached with the developing cartridges is accommodated inside the image forming apparatus.

Another prior art discloses a developing cartridge of another type that is inserted into a drum unit. The drum unit includes a photosensitive drum. When the developing cartridge is inserted into the drum unit, the photosensitive drum and developing cartridge face each other. Then, the drum unit attached with the developing cartridge is attached to the image forming apparatus.

SUMMARY

There is also known a developing cartridge including a storage medium. The storage medium is, for example, an IC chip. The storage medium includes an electric contact surface. The electric contact surface is for contacting an electric connector of the image forming apparatus or the drawer unit. However, the electric connector and electric contact surface may rub against each other while the developing cartridge is being inserted into the image forming apparatus or drawer unit.

An object of the present disclosure is to provide a configuration capable of reducing rubbing of the electric contact surface during insertion of the developing cartridge.

According to one aspect, the disclosure provides a developing cartridge including: a casing; a developing roller; a storage medium; a holder; a first lever; and a second lever. The casing is configured to accommodate therein developing agent. The developing roller is rotatable about a first axis extending in a first direction. The developing roller is positioned at one end portion of the casing defined in a second direction. The storage medium includes an electric contact surface. The holder is positioned at one end of the casing in the first direction, and is movable relative to the casing between a first position and a second position in a third direction crossing the electric contact surface. The holder has one end portion in the third direction. The one end portion holds the electric contact surface. The first lever is positioned at the one end of the casing in the first direction, and is movable relative to the casing between a third position and a fourth position about a second axis extending in the first direction. The second lever is movable together with the holder relative to the casing. The second lever is movable between a fifth position and a sixth position relative to the first lever. The holder is at the first position in a case where the second lever is at the fifth position. The holder is at the second position in a case where the second lever is at the sixth position.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
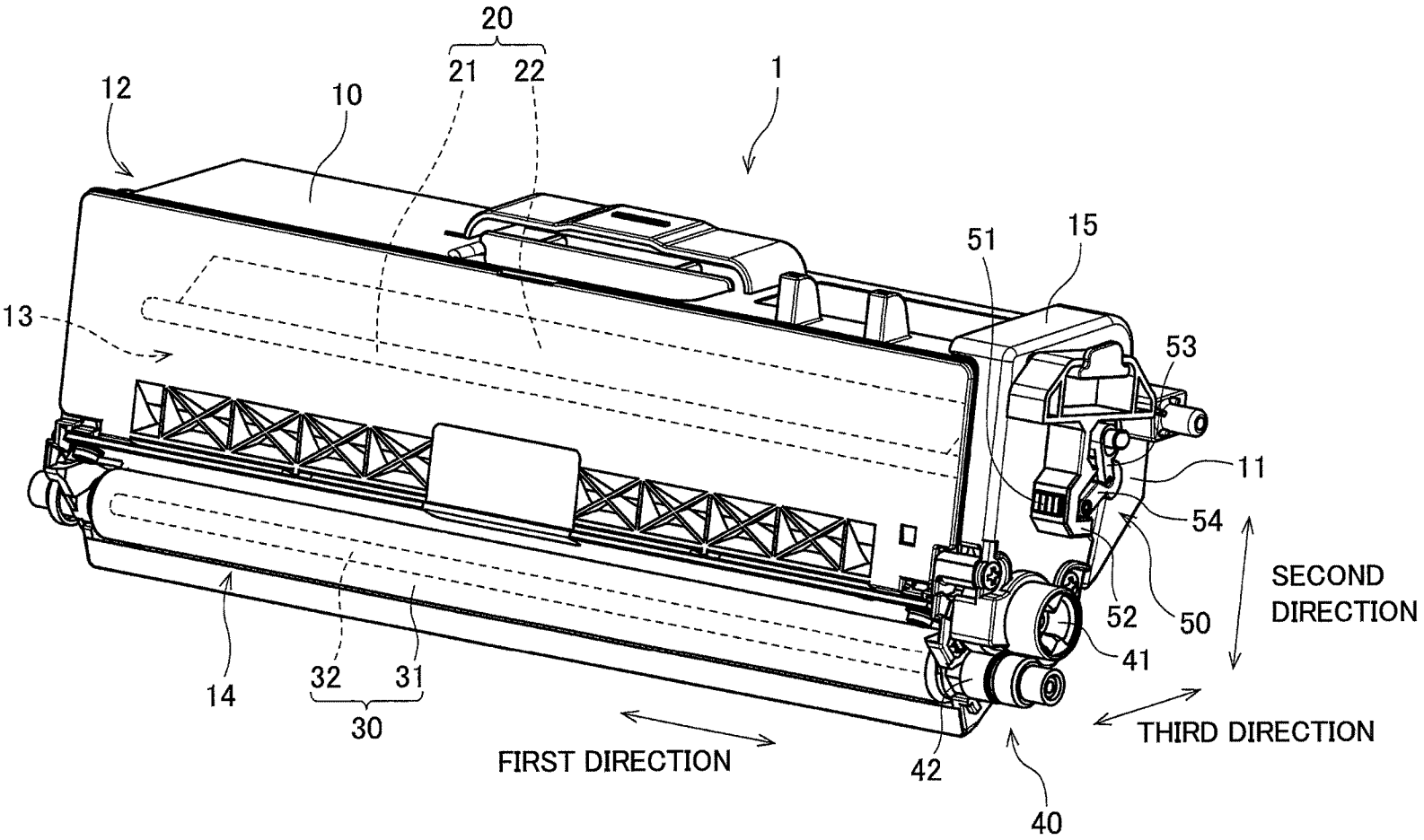
FIG. 1 is a perspective view of a developing cartridge according to a first embodiment.

A developing cartridge according to embodiments will be described while referring to the accompanying drawings wherein like parts and components are designated by the same reference numerals to avoid duplicating description.

In the following descriptions, a direction in which the rotation axis of a developing roller extends is referred to as "first direction". Further, a direction in which one end portion of a casing of a developing cartridge at which the developing roller is positioned and the other end portion thereof are arranged is referred to as "second direction". In the present embodiment, a direction in which the developing roller and an agitator are arranged is the "second direction". Further, a direction crossing an electrical contact surface is referred to as "third direction". The first direction and the second direction cross each other (preferably, cross each other at right angles). The third direction and the first direction cross each other (preferably, cross each other at right angles).

1. Entire Configuration of Developing Cartridge

Figure 2:
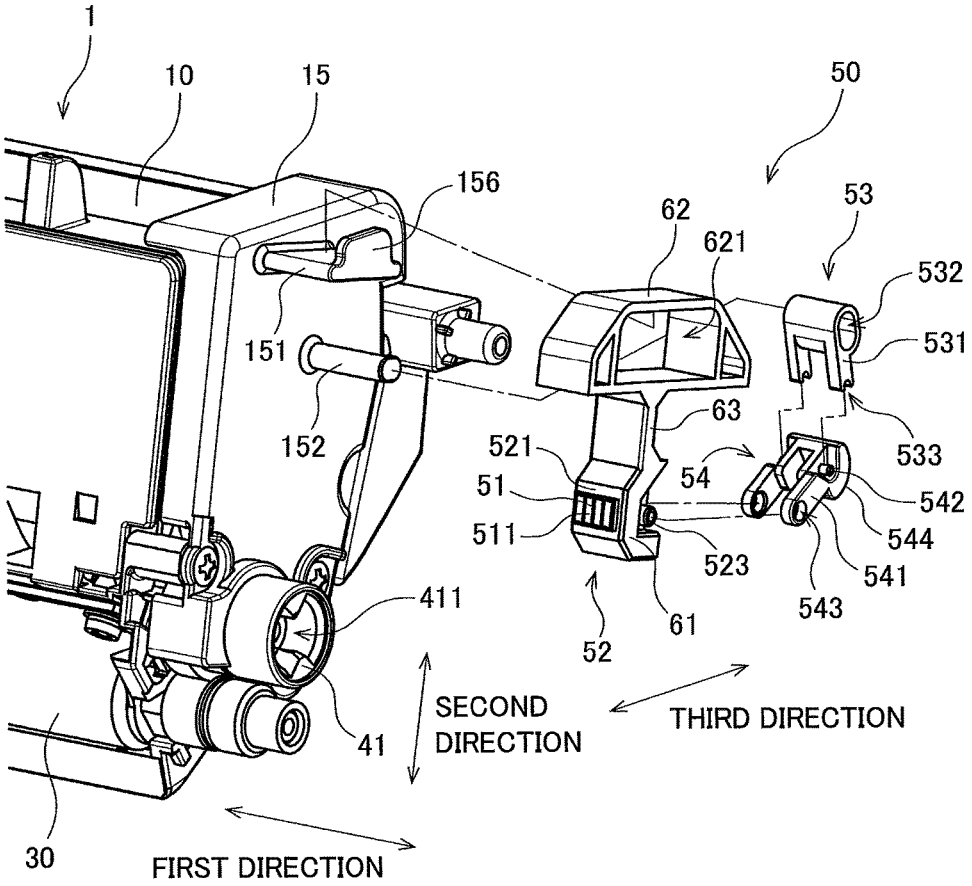
FIG. 2 is a partially exploded perspective view of the developing cartridge according to the first embodiment.

FIG. 1 is a perspective view of a developing cartridge 1 according to a first embodiment. FIG. 2 is a partially exploded perspective view of the developing cartridge 1. The developing cartridge 1 is used in an electrophotographic image forming apparatus (a laser printer, or an LED printer, for example) and is configured to supply a developing agent (toner, for example) to a photosensitive drum. The developing cartridge 1 is attached to a drawer unit included in the image forming apparatus, for example. In order to perform exchange of the developing cartridges 1, the drawer unit is pulled out from the front surface of the image forming apparatus. Then, the developing cartridges 1 are inserted in a plurality of slots formed in the drawer unit, respectively. A photosensitive drum is provided in each of the plurality of slots.

Alternatively, the developing cartridge 1 may be attached to the body portion of the image forming apparatus. In this case, a plurality of the developing cartridges 1 are inserted in a plurality of slots formed in the image forming apparatus, respectively. A photosensitive drum may be provided in each of the plurality of slots. Further alternatively, the developing cartridge 1 may be attached to a drum cartridge detachably attachable to the image forming apparatus. In this case, the drum cartridge includes a photosensitive drum. The developing cartridge 1 is attached to the drum cartridge, and the drum cartridge attached with the developing cartridge 1 is inserted in a slot formed in the image forming apparatus.

As illustrated in FIG. 1, the developing cartridge 1 according to the present embodiment includes a casing 10, an agitator 20, a developing roller 30, a gear part 40, and an IC chip assembly 50.

The casing 10 is a housing configured to accommodate developing agent therein. The casing 10 has a first end face 11 and a second end face 12. The first end face 11 is an outer surface positioned at one end of the casing 10 in the first direction. The second end face 12 is an outer surface positioned at the other end of the casing 10 in the first direction. The casing 10 extends between the first end face 11 and the second end face 12 in the first direction. Both of the gear part 40 and IC chip assembly 50 are positioned at the first end face 11. A chamber 13 is provided inside the casing 10. The developing agent is accommodated in the chamber 13. The casing 10 has an opening 14. The opening 14 is positioned at one end portion of the casing 10 in the second direction. The chamber 13 communicates with the outside of the casing 10 through the opening 14.

The casing 10 includes a gear cover 15. The gear cover 15 is fixed to the first end face 11 of the casing 10 by screwing, for example.

The agitator 20 includes an agitator shaft 21 and an agitation blade 22. The agitator shaft 21 is rotatable about a rotation axis of the agitator shaft that extends in the first direction. The agitation blade 22 extends outward from the agitator shaft 21 in the radial direction. At least a portion of the agitator shaft 21 and the entire agitation blade 22 are positioned inside the chamber 13. One end portion of the agitator shaft 21 in the first direction is fixed to an agitator gear, which constitutes the gear part 40, so as not to be rotatable relative to the agitator gear. Therefore, the agitator shaft 21 and agitation blade 22 are rotatable together with the agitator gear. When the agitation blade 22 rotates, the developing agent in the chamber 13 is agitated.

The developing roller 30 is rotatable about a rotation axis of the developing roller 30 (an example of a first axis) that extends in the first direction. The developing roller 30 is positioned at the opening 14 of the casing 10. That is, the developing roller 30 is positioned at one end portion of the casing 10 in the second direction. The developing roller 30 in the present embodiment includes a developing roller body 31 and a developing roller shaft 32. The developing roller body 31 is a cylindrical member extending in the first direction. As a material for the developing roller body 31, rubber having elasticity is used, for example. The developing roller shaft 32 is a columnar member penetrating the developing roller body 31 in the first direction. As a material for the developing roller shaft 32, metal or resin having electric conductivity is used. The developing roller body 31 is fixed to the developing roller shaft 32 so as not to be rotatable relative to the developing roller shaft 32.

A developing roller gear 42, which constitutes the gear part 40, is mounted to one end portion of the developing roller shaft 32 in the first direction. More in detail, the one end portion of the developing roller shaft 32 in the first direction is fixed to the developing roller gear 42 so as not to be rotatable relative to the developing roller gear 42. Thus, when the developing roller gear 42 rotates, the developing roller shaft 32 also rotates, so that the developing roller body 31 rotates together with the developing roller shaft 32.

The developing roller shaft 32 may not necessarily penetrate the developing roller body 31 in the first direction. For example, a pair of developing roller shafts 32 may extend in the first direction from opposite ends of the developing roller body 31 in the first direction.

The developing cartridge 1 includes an unillustrated supply roller. The supply roller is positioned between the developing roller 30 and the agitator 20. Further, the supply roller is rotatable about a rotation axis of the supply roller that extends in the first direction. When the developing cartridge 1 receives drive force, developing agent is supplied from the chamber 13 inside the casing 10 to the outer peripheral surface of the developing roller 30 via the supply roller. At this time, the developing agent is triboelectrically charged between the supply roller and the developing roller 30. The developing roller shaft 32 of the developing roller 30 is applied with bias voltage. Therefore, developing agent is attracted to the outer peripheral surface of the developing roller body 31 by electrostatic force between the developing roller shaft 32 and the developing agent.

Further, the developing cartridge 1 includes a layer thickness regulation blade (not illustrated). The layer thickness regulation blade regulates the thickness of the developing agent supplied to the outer peripheral surface of the developing roller body 31 to a constant thickness. The developing agent on the outer peripheral surface of the developing roller body 31 is then supplied to a photosensitive drum provided in the drawer unit. At this time, the developing agent is moved to the photosensitive drum from the developing roller body 31 according to an electrostatic latent image formed on the outer peripheral surface of the photosensitive drum. As a result, the electrostatic latent image is developed into a visible image on the outer peripheral surface of the photosensitive drum.

The gear part 40 is positioned at the first end face 11 of the casing 10. The gear part 40 includes a plurality of gears including the above-mentioned agitator gear and developing roller gear 42, and a coupling 41. At least a portion of the plurality of gears is covered by the gear cover 15. The coupling 41 has a fastening hole 411. The fastening hole 411 is exposed from the gear cover 15. When the drawer unit attached with the developing cartridge 1 is accommodated in the image forming apparatus, a drive shaft constituting the image forming apparatus is inserted into the fastening hole 411 of the coupling 41. Then, the rotation of the drive shaft is transmitted via the coupling 41 to the plurality of gears including the agitator gear and developing roller gear 42.

The plurality of gears included in the gear part 40 may transmit a torque by teeth engagement or friction. For example, the plurality of gears may have an outer peripheral surface formed of rubber in place of an outer peripheral surface formed with teeth.

<1-2. IC Chip Assembly>

The IC chip assembly 50 is a unit including an IC chip 51 as an example of a storage medium. The IC chip assembly 50 is positioned at one end of the casing 10 in the first direction. In the present embodiment, the IC chip assembly 50 is positioned at the outer surface of the gear cover 15. As illustrated in FIGS. 1 and 2, the IC chip assembly 50 includes an IC chip 51, a holder 52, a first lever 53, and a second lever 54. The holder 52, first lever 53, and second lever 54 are separate members.

The IC chip 51 is a storage medium of a plate shape. The IC chip 51 stores various types of information concerning the developing cartridge 1. As illustrated in FIG. 2, the IC chip 51 includes an electrical contact surface 511. The electrical contact surface 511 is made of metal which is an electric conductor. Correspondingly, the drawer unit includes an electrical connector 911 to be described later. When the developing cartridge 1 is attached to the drawer unit, the electrical contact surface 511 of the IC chip 51 contacts the electrical connector 911.

The holder 52 includes a holding surface 521. The holding surface 521 is an outer surface at one end of the holder 52 in the third direction. The IC chip 51 is held on the holding surface 521. For example, the IC chip 51 is fixedly secured to the holding surface 521. The IC chip 51 may be fitted in a recessed part formed in the holding surface 521. Alternatively, the IC chip 51 may be fixed to the holding surface 521 by an adhesive. The IC chip 51 may be configured to be slightly movable relative to the holding surface 521. The holder 52 and the electrical contact surface 511 of the IC chip 51 need only be movable together.

The holder 52 of the present embodiment has a holder body 61 and an engagement part 62. The holder body 61 includes the holding surface 521. The engagement part 62 is positioned at a position in the second direction that is farther from the developing roller 30 than the holder body 61 is from the developing roller 30. The length of the engagement part 62 in the third direction is larger than the length of the holder body 61 in the third direction. The holder body 61 and the engagement part 62 are continuous with each other via a relay part 63 extending in the second direction. The holder body 61, engagement part 62, and relay part 63 are integrally formed of resin, for example.

The engagement part 62 has a holder through-hole 621. The holder through-hole 621 penetrates the engagement part 62 in the first direction. Correspondingly, the gear cover 15 includes a cover boss 151. The cover boss 151 extends in the first direction from the outer surface of the gear cover 15 to the holder 52. The cover boss 151 is inserted in the holder through-hole 621.

The length of the holder through-hole 621 (inner dimension) in the second direction is larger than the length of the cover boss 151 (outer dimension) in the second direction. Thus, the holder 52 can move in the second direction relative to the gear cover 15 in a state where the cover boss 151 is kept inserted in the holder through-hole 621. That is, the holder 52 can move in the second direction relative to the casing 10 in a state where the cover boss 151 is kept inserted in the holder through-hole 621. When the holder 52 moves in the second direction relative to the casing 10, the electrical contact surface 511 moves together with the holder 52 in the second direction. That is, when the holder 52 moves in the second direction relative to the casing 10, the IC chip 51 including the electrical contact surface 511 moves together with the holder 52 in the second direction.

The length of the holder through-hole 621 (inner dimension) in the third direction is greater than the length of the cover boss 151 (outer dimension) in the third direction. Thus, the holder 52 can move in the third direction relative to the gear cover 15 in a state where the cover boss 151 is kept inserted in the holder through-hole 621. That is, the holder 52 can move in the third direction relative to the casing 10 in a state where the cover boss 151 is kept inserted in the holder through-hole 621. The holder 52 can move relative to the casing 10 between first and second positions to be described later. When the holder 52 moves in the third direction relative to the casing 10, the electrical contact surface 511 moves together with the holder 52 in the third direction. That is, when the holder 52 moves in the third direction relative to the casing 10, the IC chip 51 including the electrical contact surface 511 moves together with the holder 52 in the third direction.

The gear cover 15 includes a wall part 156. The wall part 156 extends in the second direction from a distal end of the cover boss 151 in the first direction. A portion of the engagement part 62 is positioned between the outer surface of the gear cover 15 and the wall part 156. When the engagement part 62 receives such force that is directed away from the gear cover 15 in the first direction, the engagement part 62 abuts against the wall part 156. This prevents the engagement part 62 from coming off from the cover boss 151 in the first direction. The length between the outer surface of the gear cover 15 and the wall part 156 in the first direction is slightly greater than the length of the engagement part 62 in the first direction. Accordingly, the holder 52 can move slightly in the first direction relative to the cover boss 151.

The gear cover 15 may include a plurality of cover bosses 151. In this case, the engagement part 62 includes one or a plurality of holder through-holes 621 into which the plurality of cover bosses 151 are inserted. Plural cover bosses 151 may be inserted into one holder through-hole 621. The engagement part 62 may have a recessed part into which the cover boss 151 is inserted, in place of the holder through-hole 621. Further, the gear cover 15 may have a through-hole or a recessed part. In this case, the engagement part 62 includes a boss extending in the first direction toward the gear cover 15, and the boss of the engagement part 62 is inserted into the through-hole or recessed part of the gear cover 15.

The first lever 53 is positioned between the engagement part 62 and the second lever 54 in the second direction. The first lever 53 is positioned at a side opposite to the holding surface 521 relative to the relay part 63 in the third direction. The first lever 53 has a first arm part 531, a first through-hole 532, and a first notch 533. The first through-hole 532 is positioned at one end portion of the first arm part 531. The first through-hole 532 penetrates the first lever 53 in the first direction. The first notch 533 is positioned at the other end portion of the first arm part 531. The gear cover 15 includes a first boss 152 (an example of a shaft). The first boss 152 extends in the first direction from the outer surface of the gear cover 15 toward the first lever 53. The first boss 152 is inserted into the first through-hole 532. The first lever 53 can pivotally move about the center axis of the first boss 152 (an example of a second axis). With this configuration, the first lever 53 can pivotally move between third and fourth positions to be described later relative to the casing 10.

The length of the first through-hole 532 (inner dimension) in the second direction is greater than the length of the first boss 152 (outer dimension) in the second direction. Thus, the first lever 53 can move in the second direction relative to the first boss 152. That is, the first lever 53 can move in the second direction relative to the casing 10.

The first lever 53 may have a recessed part into which the first boss 152 is inserted, in place of the first through-hole 532. Further, the gear cover 15 may have a through-hole or a recessed part. The first lever 53 may have a boss extending in the first direction toward the gear cover 15, and the boss of the first lever 53 is inserted into the through-hole or recessed part of the gear cover 15.

The second lever 54 is positioned at the side opposite to the engagement part 62 in the second direction relative to the first lever 53. Further, the second lever 54 is positioned at the side opposite to the holding surface 521 in the third direction relative to the holder body 61. The second lever 54 has a second arm part 541, a second boss 542, and a second through-hole 543. The second boss 542 is positioned at one end portion of the second arm part 541. The second boss 542 extends in the first direction. The second boss 542 is fitted in the first notch 533. In this manner, the other end portion of the first lever 53 and the one end portion of the second lever 54 are connected to each other, allowing the second lever 54 to pivotally move about the second boss 542 relative to the first lever 53.

The first lever 53 may have a through-hole or a recessed part into which the second boss 542 is inserted, in place of the first notch 533. Further, the second lever 54 may have a notch, a through-hole or a recessed part. The first lever 53 may have a boss extending in the first direction toward the second lever 54. The boss of the first lever 53 may be inserted into the notch, through-hole or recessed part of the second lever 54.

The second through-hole 543 is positioned at the other end portion of the second arm part 541. The second through-hole 543 penetrates the second lever 54 in the first direction. The holder 52 includes a third boss 523. The third boss 523 is positioned at an end portion of the holder body 61 on the side opposite to the holding surface 521 in the third direction. The third boss 523 extends in the first direction. The third boss 523 is inserted into the second through-hole 543. As a result, the other end portion of the second lever 54 is connected to the holder 52, allowing the second lever 54 to pivotally move about the center axis of the third boss 523 (an example of a third axis) relative to the holder 52.

The second lever 54 may have a recessed part into which the third boss 523 is inserted, in place of the second through-hole 543. Further, the holder 52 may have a through-hole or a recessed part. The second lever 54 may have a boss extending toward the holder 52 in the first direction. The boss of the second lever 54 may be inserted into the through-hole or recessed part of the holder 52.

As described above, the second lever 54 is connected to both of the first lever 53 and the holder 52 so as to be pivotally movable relative to both of the first lever 53 and the holder 52. Thus, the second lever 54 can move together with the holder 52 relative to the casing 10. Further, the second lever 54 can pivotally move between fifth and sixth positions (to be described later) relative to the first lever 53.

Further, the second lever 54 includes a guide surface 544. The guide surface 544 is the outer surface of the second lever 54 positioned at one end portion thereof. The guide surface 544 is a sloped surface that is inclined relative to the second direction such that the guide surface 544 approaches the holding surface 521 as proceeding toward the developing roller 30. The guide surface 544 is preferably a curved surface protruding outward in the radial direction relative to the second boss 542. For example, the guide surface 544 is preferably formed into a curved surface of an arc shape that is centered on the second boss 542.

<1-3. Insertion Operation>

Next will be described an insertion operation of the developing cartridge 1 into the drawer unit. FIGS. 3 to 6 are views illustrating states where the developing cartridge 1 is being inserted into the drawer unit.

As illustrated in FIGS. 3 to 6, the drawer unit includes a first guide plate 91 and a second guide plate 92. The first and second guide plates 91 and 92 face each other in the third direction with an interval therebetween. When the developing cartridge 1 is inserted into the drawer unit, the IC chip assembly 50 is inserted into the space between the first and second guide plates 91 and 92.

As illustrated in FIGS. 3 to 6, the first guide plate 91 includes the electrical connector 911 and a guide protrusion 912. The electrical connector 911 is an electric conductor that can contact the electrical contact surface 511. The electrical connector 911 is in electrical connection with a control unit provided in the image forming apparatus. The electrical connector 911 protrudes in the third direction from the surface of the first guide plate 91 toward the second guide plate 92. The guide protrusion 912 is positioned in the second direction farther from the photosensitive drum 93 than the electrical connector 911 is from the photosensitive drum 93. The guide protrusion 912 protrudes from the surface of the first guide plate 91 toward the second guide plate 92.

Figure 3:
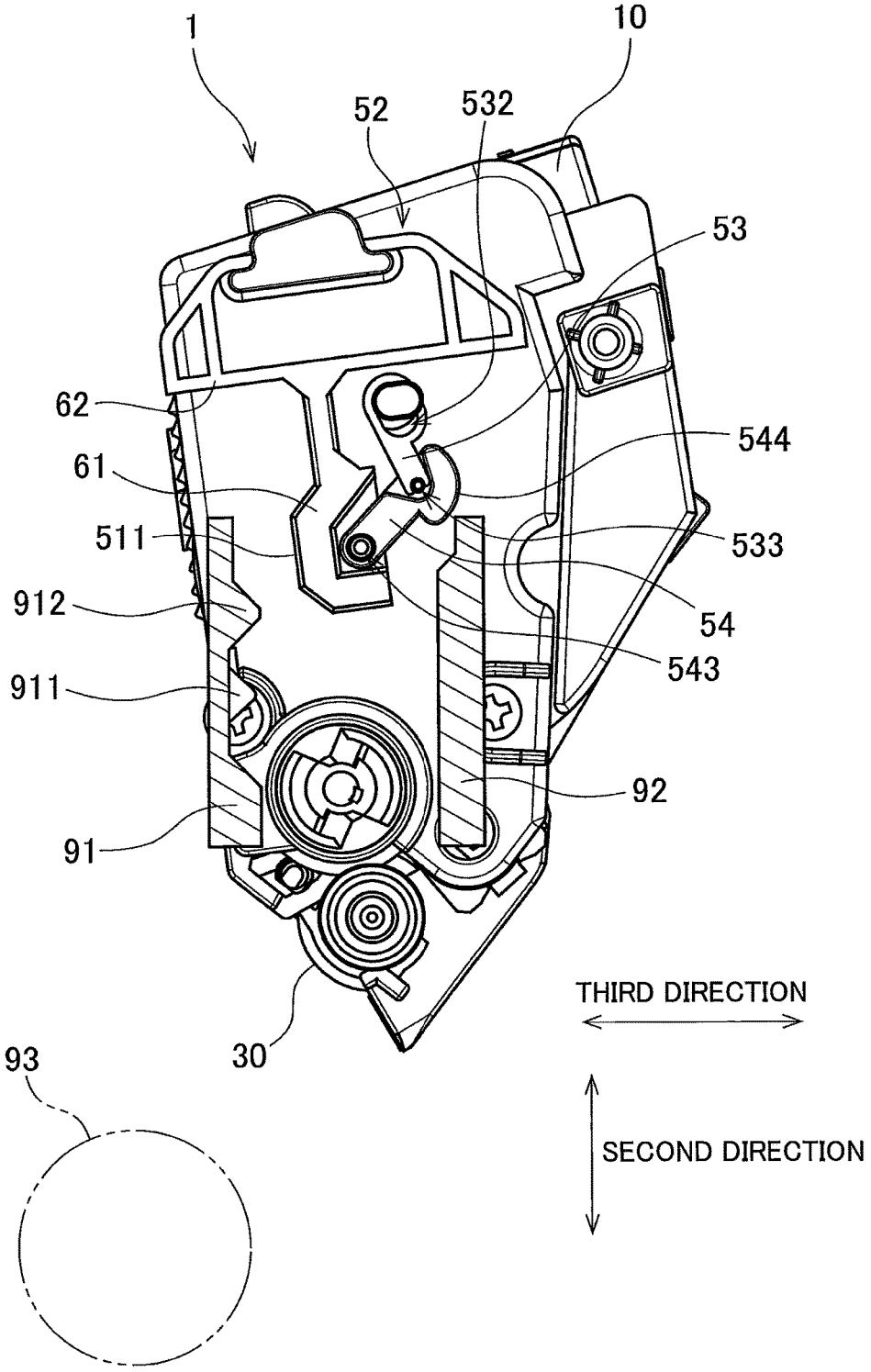
FIG. 3 is a view illustrating a state of the developing cartridge according to the first embodiment during an insertion operation thereof.

At the time of insertion of the developing cartridge 1 into the drawer unit, first, the holder body 61 and the second lever 54 are inserted into the space between the first and second guide plates 91 and 92, as illustrated in FIG. 3. In the state illustrated in FIG. 3, the engagement part 62 does not contact any of the first guide plate 91 and the second guide plate 92. At this time, the first lever 53 is at the third position relative to the casing 10. The second lever 54 is at the fifth position relative to the first lever 53.

The orientation of the first lever 53 is closer to a direction parallel to the second direction when the first lever 53 is at the third position than when the first lever 53 is at the fourth position to be described later. Specifically, a direction, in which the first through-hole 532 and the first notch 533 are arranged when the first lever 53 is at the third position, is closer to the second direction than a direction, in which the first through-hole 532 and the first notch 533 are arranged when the first lever 53 is at the fourth position to be described later. When the second lever 54 is at the fifth position, the second lever 54 is inclined relative to the third direction. Specifically, in the second direction, the guide surface 544 is more apart from the developing roller 30 than the second through-hole 543 is from the developing roller 30.

Figure 4:
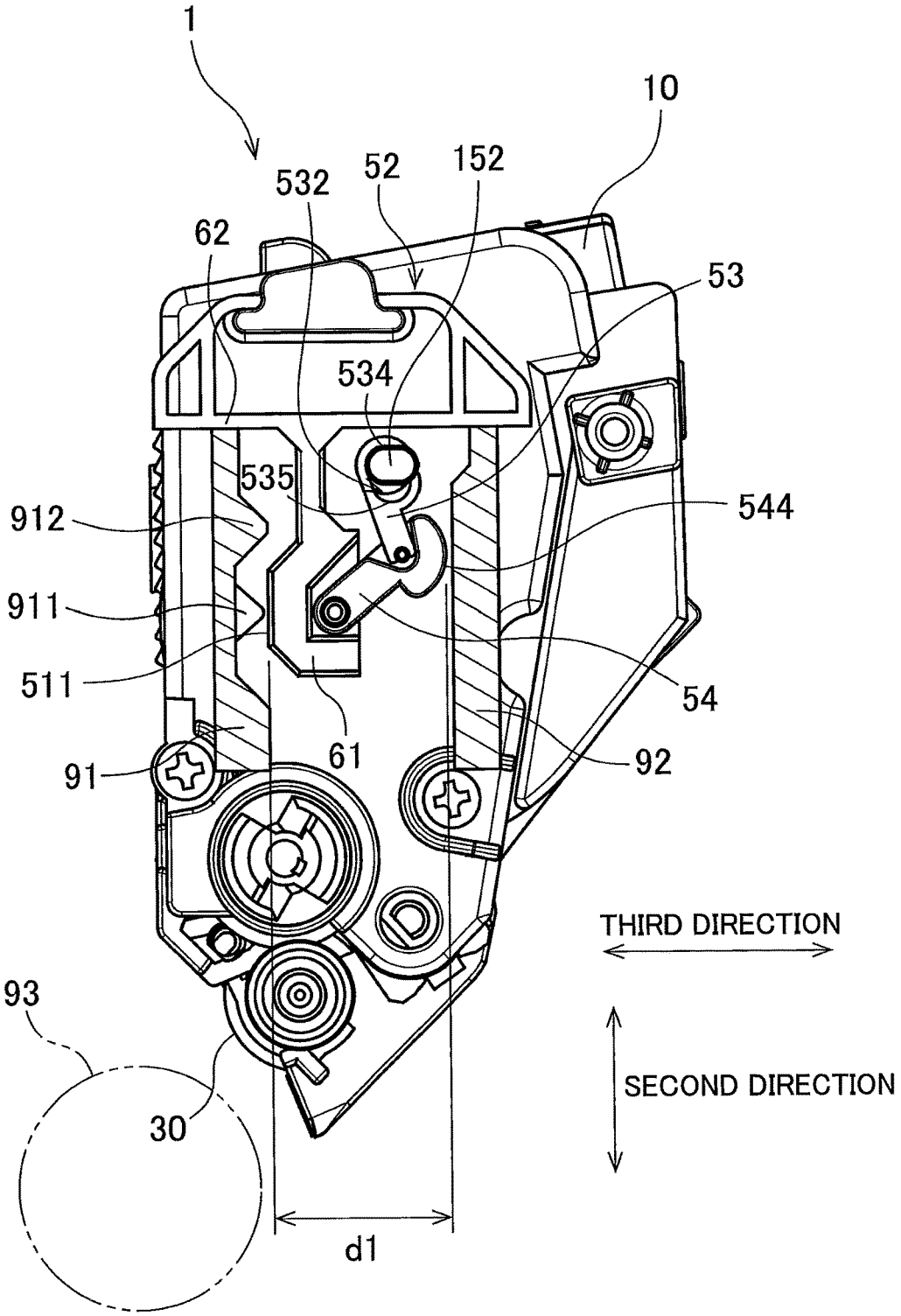
FIG. 4 is a view illustrating a state of the developing cartridge according to the first embodiment during the insertion operation thereof.
Figure 5:
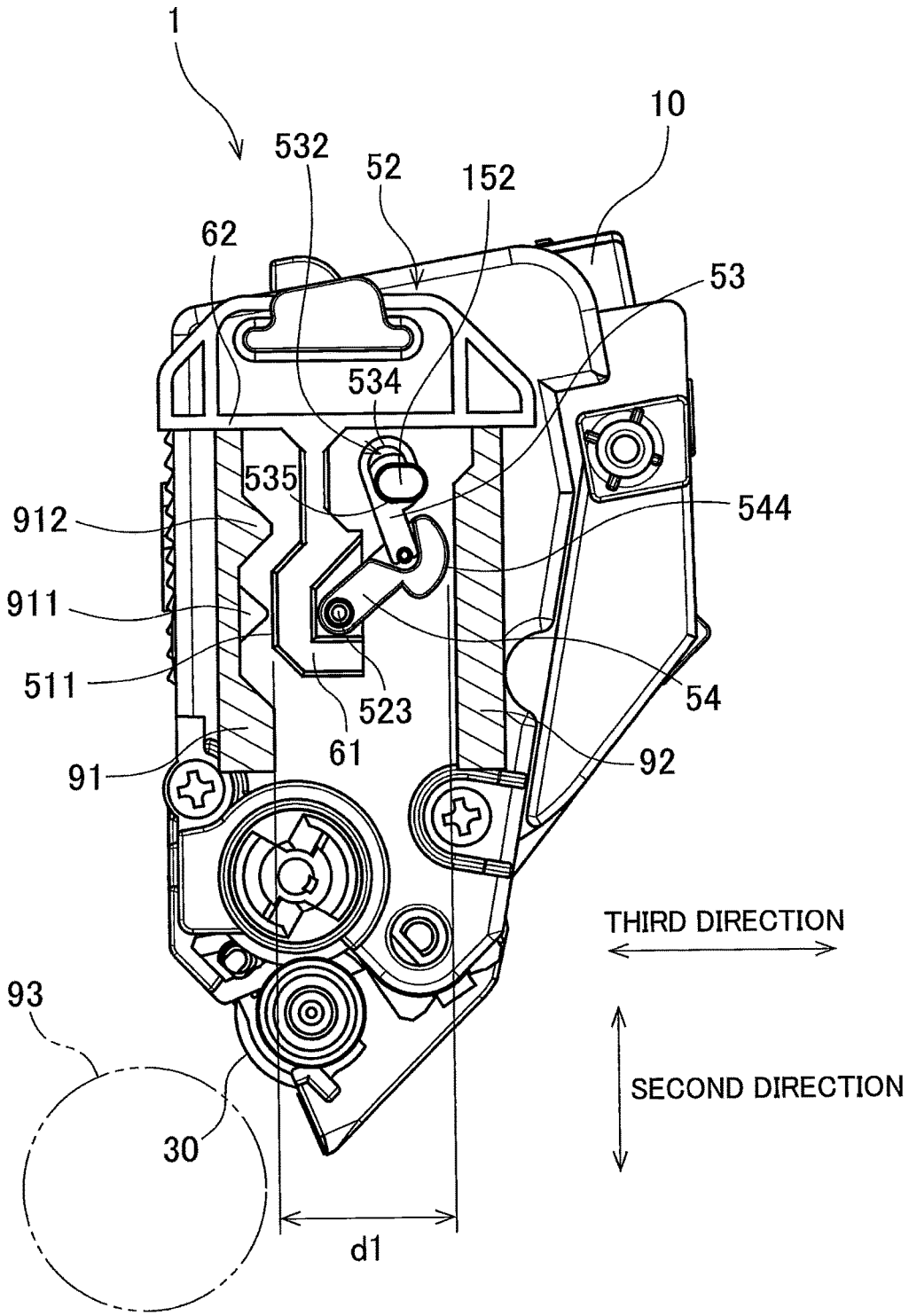
FIG. 5 is a view illustrating a state of the developing cartridge according to the first embodiment during the insertion operation thereof.

In this state, the second lever 54 has a pair of opposite end portions in the third direction, and a length in the third direction between the electrical contact surface 511 and one of the opposite end portions of the second lever 54 that is farther away from the electrical contact surface 511 than the remaining one of the opposite end portions is from the electrical contact surface 511, is equal to a first length d1 (see FIGS. 4 and 5). The first length d1 is smaller than the interval between the guide protrusion 912 and the second guide plate 92 in the third direction. This ensures that the IC chip 51, holder body 61, and second lever 54 pass between the guide protrusion 912 and the second guide plate 92.

After the IC chip 51 passes by the guide protrusion 912, the engagement part 62 contacts the first and second guide plates 91 and 92, as illustrated in FIG. 4. Specifically, a portion of the engagement part 62 contacts one of the opposite end portions of the first guide plate 91 in the second direction that is farther from the photosensitive drum 93 than the other end portion is from the photosensitive drum 93. Further, another portion of the engagement part 62 contacts one of the opposite end portions of the second guide plate 92 in the second direction that is farther from the photosensitive drum 93 than the other end portion is from the photosensitive drum 93. Thus, the engagement part 62 engages with the first and second guide plates 91 and 92. As a result, the holder 52 is fixed in position relative to the first and second guide plates 91 and 92 in the second direction.

Subsequently, when the casing 10 in the state illustrated in FIG. 4 is inserted further in the second direction toward the photosensitive drum 93, the casing 10 moves relative to the holder 52 in a direction toward the photosensitive drum 93 as illustrated in FIG. 5, with the position of the holder 52 relative to the first and second guide plates 91 and 92 being fixed in the second position. At this time, the cover boss 151 becomes separated away from the peripheral edge portion of the holder through-hole 621 of the engagement part 62. Further, the first boss 152 is separated away from a part 534 of the peripheral edge portion of the first through-hole 532 of the first lever 53 that is closer to the engagement part 62 than the other remaining part is to the engagement part 62. That is, the first boss 152 becomes positioned further away from the engagement part 62 in a state where the first boss 152 is kept inserted in the first through-hole 532.

At this point of time, the first lever 53 still remains at the third position relative to the casing 10. Also, the second lever 54 is still at the fifth position relative to the first lever 53. Accordingly, the length in the third direction between the electrical contact surface 511 and the one end portion of the second lever 54 in the third direction that is farther away from the electrical contact surface 511 than the other end portion is from the electrical contact surface 511, still remains at the first length d1. Further, the holder 52 is at the first position relative to the casing 10 in the third direction. When the holder 52 is at the first position, the electrical contact surface 511 of the IC chip 51 is out of contact with the electrical connector 911. However, while the holder 52 is at the first position, the electrical contact surface 511 of the IC chip 51 may temporarily contact the electrical connector 911.

Figure 6:
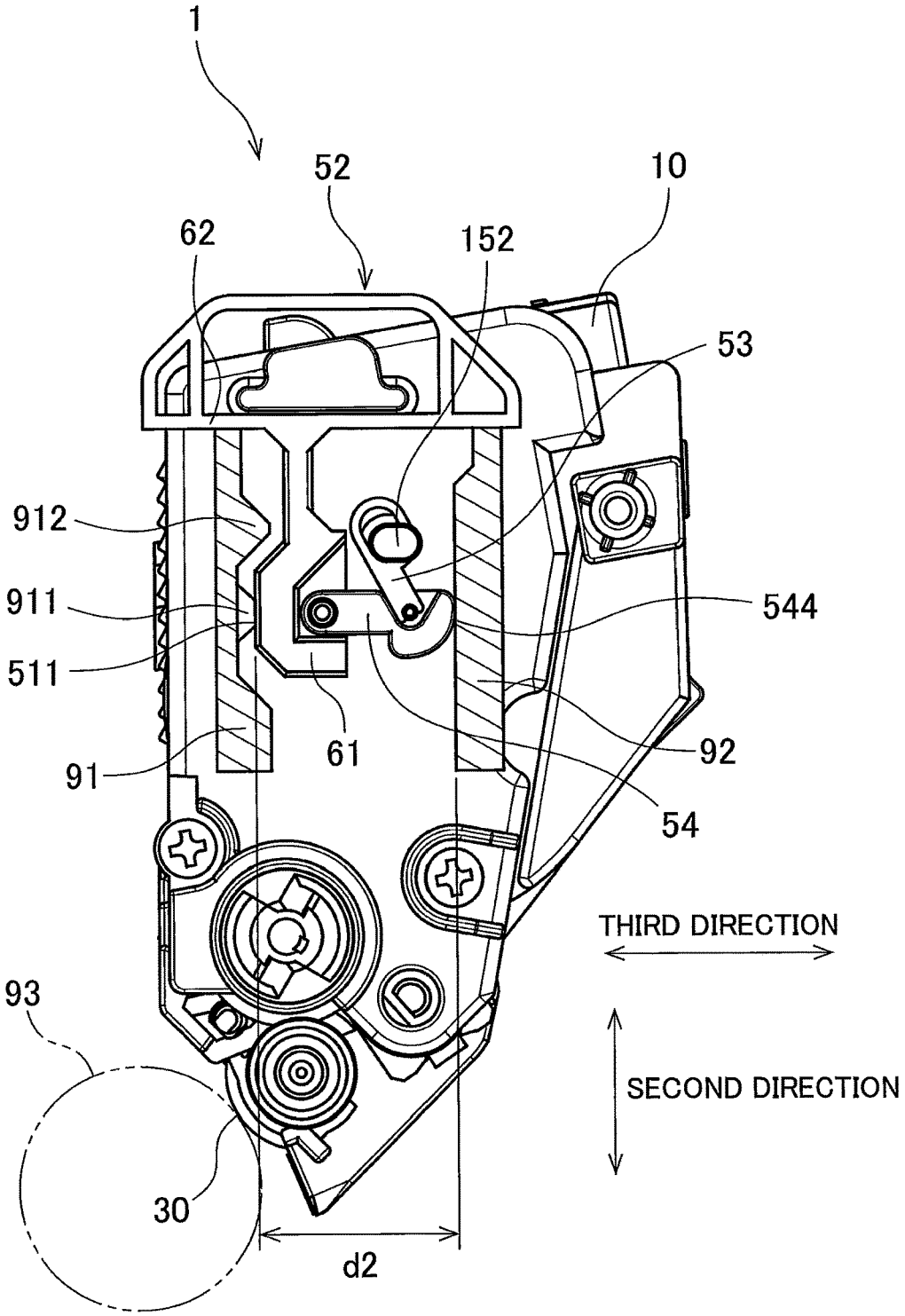
FIG. 6 is a view illustrating a state of the developing cartridge according to the first embodiment during the insertion operation thereof.

Thereafter, when the casing 10 is further inserted in the second direction toward the photosensitive drum 93, the first boss 152 contacts a part 535 of the peripheral edge portion of the first through-hole 532 of the first lever 53 that is farther away from the engagement part 62 than the other remaining part is from the engagement part 62. As a result, the first lever 53 receives, from the first boss 152, such pressure that is directed toward the photosensitive drum 93 in the second direction. Thus, as illustrated in FIG. 6, the first lever 53 presses the second lever 54 toward the photosensitive drum 93, while pivotally moving from the third position to the fourth position. This causes the second lever 54 to pivotally move about the third boss 523. That is, the second lever 54 pivotally moves by a force transmitted from the casing 10 via the first lever 53. As a result, the second lever 54 moves relative to the first lever 53 from the fifth position to the sixth position.

When the second lever 54 becomes positioned at the sixth position, the orientation of the second lever 54 becomes parallel to the third direction. The guide surface 544 is brought into contact with the second guide plate 92. This makes the holder 52 move in the third direction toward the first guide plate 91. That is, the holder 52 moves relative to the casing 10 from the first position to the second position in the third direction. At this time, the length in the third direction between the electrical contact surface 511 and the one end portion of the second lever 54 in the third direction that is farther away from the electrical contact surface 511 than the other end portion of the second lever 54 in the third direction is from the electrical contact surface 511, becomes equal to a second length d2 that is greater than the first length d1, thereby bringing the electrical contact surface 511 of the IC chip 51 into contact with the electrical connector 911. As a result, the electrical contact surface 511 and the electrical connector 911 are brought into electrical conduction with each other, thereby allowing the image forming apparatus to perform at least one of reading and writing operations of information from/into the IC chip 51.

As described above, in the developing cartridge 1 of the present embodiment, the first lever 53 and the second lever 54 move during insertion of the developing cartridge 1 into the drawer unit. Then, in association with the movement of the first and second levers 53 and 54, the electrical contact surface 511 moves together with the holder 52 in the third direction. As a result, the electrical contact surface 511 contacts the electrical connector 911. Thus, the developing cartridge 1 can be inserted into the drawer unit while suppressing rubbing of the electrical contact surface 511.

<1-4. Separation Operation>

Figure 7:
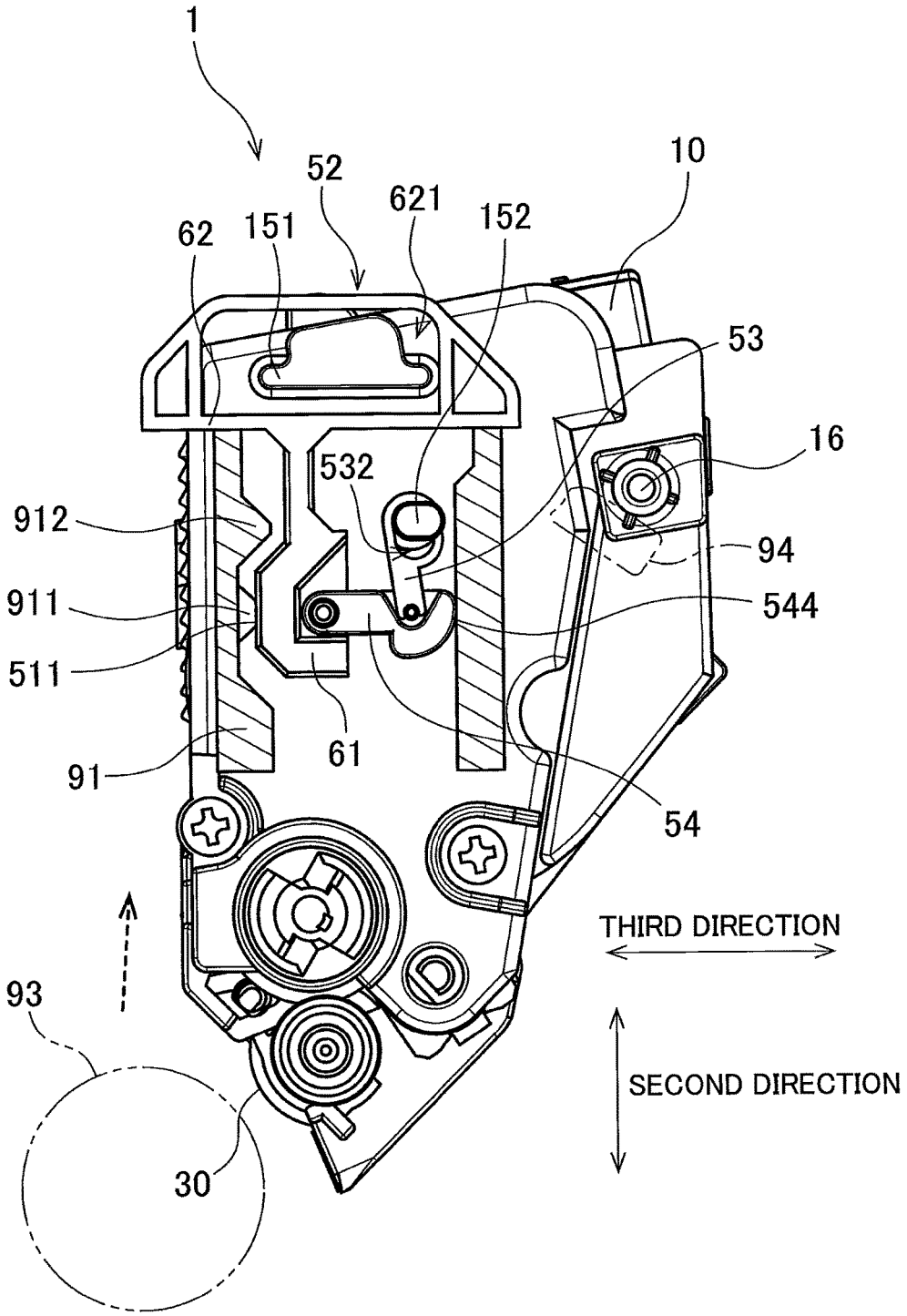
FIG. 7 is a view illustrating a state of the developing cartridge according to the first embodiment during a separation operation thereof.

After completion of the above-described insertion operation, the image forming apparatus can perform so-called "separation operation" of temporarily separating the developing roller 30 from the photosensitive drum 93. Next will be described the separation operation. FIG. 7 is a view illustrating a state where the separation operation is performed.

As illustrated in FIG. 7, the casing 10 includes a protrusion 16. The protrusion 16 extends in the first direction from the first end face 11 of the casing 10. At the time of the separation operation, a pressing lever constituting the drawer unit (not illustrated) is pressed by drive force from the image forming apparatus. As a result, a separation member 94 constituting the drawer unit moves in a direction away from the photosensitive drum 93. The separation member 94 contacts the protrusion 16 to press the protrusion 16 in a direction away from the photosensitive drum 93. As a result, as denoted by the dashed arrow in FIG. 7, the casing 10 and developing roller 30 of the developing cartridge 1 move in the second direction relative to the drawer unit. As a result, the developing roller 30 and the photosensitive drum 93 become separated from each other.

The position of the holder 52 relative to the drawer unit is not changed over the time from before the separation operation is started and until after the separation operation is completed. The casing 10 moves relative to the holder 52 in the second direction, with the cover boss 151 being kept inserted in the holder through-hole 621. The casing 10 moves relative to the first lever 53 in the second direction, with the first boss 152 being kept inserted in the first through-hole 532. The guide surface 544 of the second lever 54 is maintained in contact with the second guide plate 92 over the time from before the separation operation is started and until after the separation operation is completed. Further, over the time from before the separation operation is started and until after the separation operation is completed, the electrical contact surface 511 is maintained in contact with the electrical connector 911. Thus, rubbing of the electrical contact surface 511 can be suppressed during the separation operation.

In the present embodiment, both the insertion direction of the developing cartridge 1 into the drawer unit and a direction (separation direction) in which the developing roller 30 is separated from the photosensitive drum 93 at the separation operation coincide with the second direction. However, the insertion direction and the separation direction may differ from each other. Each of the insertion direction and the separation direction only needs to cross the first direction.

<1-5. Removal Operation>

Figure 8:
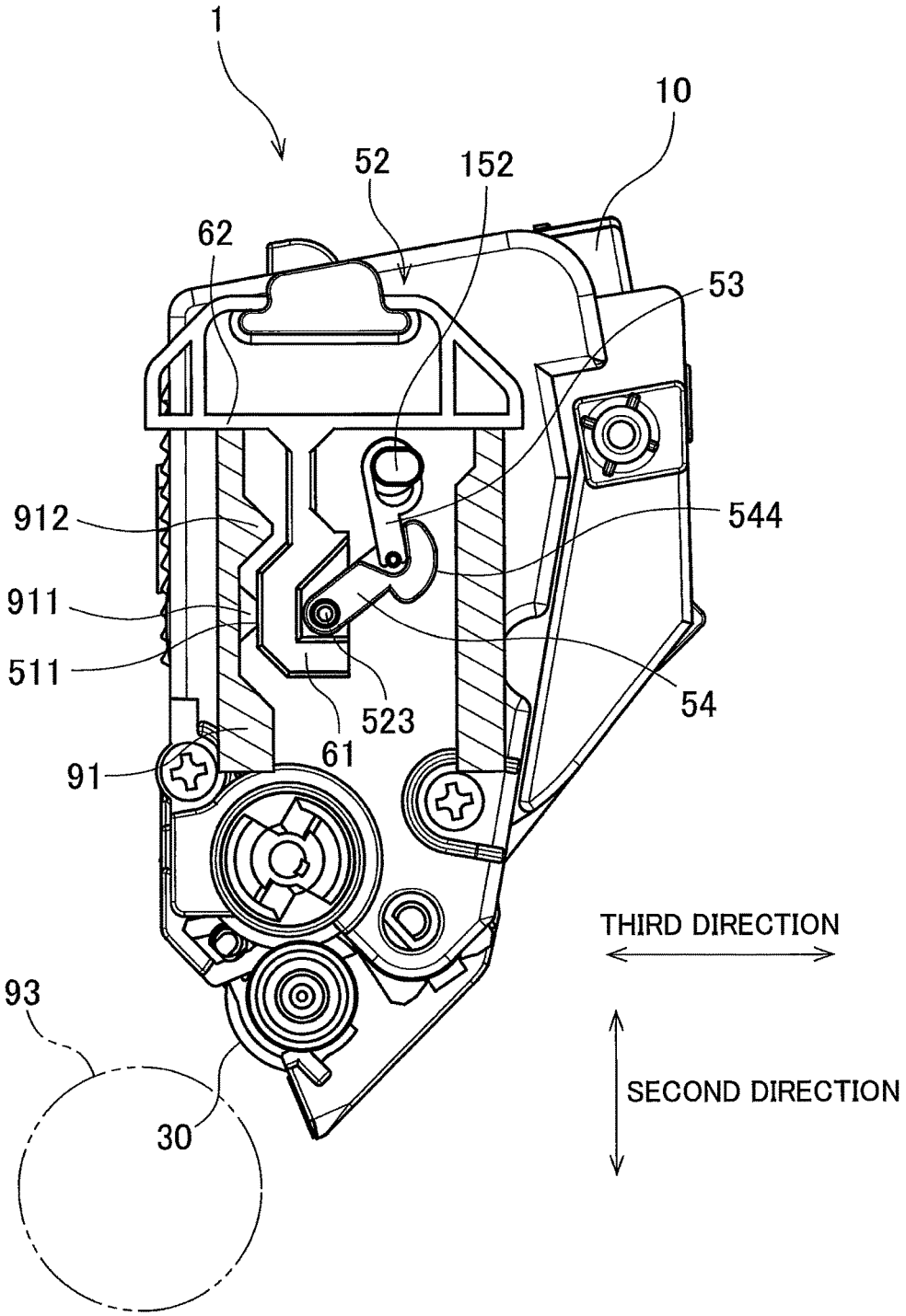
FIG. 8 is a view illustrating a state of the developing cartridge according to the first embodiment during a removing operation thereof.

FIG. 8 is a view illustrating a state where the developing cartridge 1 is removed from the drawer unit. When the developing cartridge 1 is removed from the drawer unit, the casing 10 is pulled in a direction away from the photosensitive drum 93. As a result, the first boss 152 moves together with the casing 10 in a direction away from the photosensitive drum 93. Because the first boss 152 is inserted in the first through-hole 532 of the first lever 53, when the first boss 152 moves in a direction away from the photosensitive drum 93, the first lever 53 receives, from the first boss 152, such pressure that is directed away from the photosensitive drum 93 in the second direction. As a result, the first lever 53 also moves in the direction away from the photosensitive drum 93. Further, as illustrated in FIG. 8, the first lever 53 pivotally moves from the fourth position to the third position. Further, in association with the movement of the first lever 53, the first lever 53 pulls the second lever 54 in a direction away from the photosensitive drum 93. As a result, the second lever 54 pivotally moves about the third boss 523. That is, the second lever 54 is pivotally moved by a force transmitted from the casing 10 via the first lever 53. As a result, the position of the second lever 54 relative to the first lever 53 moves from the sixth position to the fifth position.

As a result, the length in the third direction between the electrical contact surface 511 and the one end portion of the second lever 54 in the third direction that is farther away from the electrical contact surface 511 than the other end portion of the second lever 54 in the third direction is from the electrical contact surface 511, becomes equal to the first length d1. Further, the holder 52 becomes positioned at the first position relative to the casing 10 in the third direction. Accordingly, the electrical contact surface 511 of the IC chip 51 is separated away from the electrical connector 911. Then, the IC chip 51, holder body 61, and second lever 54 pass through the space between the guide protrusion 912 and the second guide plate 92.

2. Second Embodiment

<2-1. Configuration of Developing Cartridge>

Next, a developing cartridge 1A according to a second embodiment will be described. The second embodiment differs from the first embodiment in the structures of a holder, a first lever, and a second lever in the IC chip assembly. Hereinafter, the same reference numerals are given to the parts other than the IC chip assembly, and duplicated descriptions will be omitted.

Figure 9:
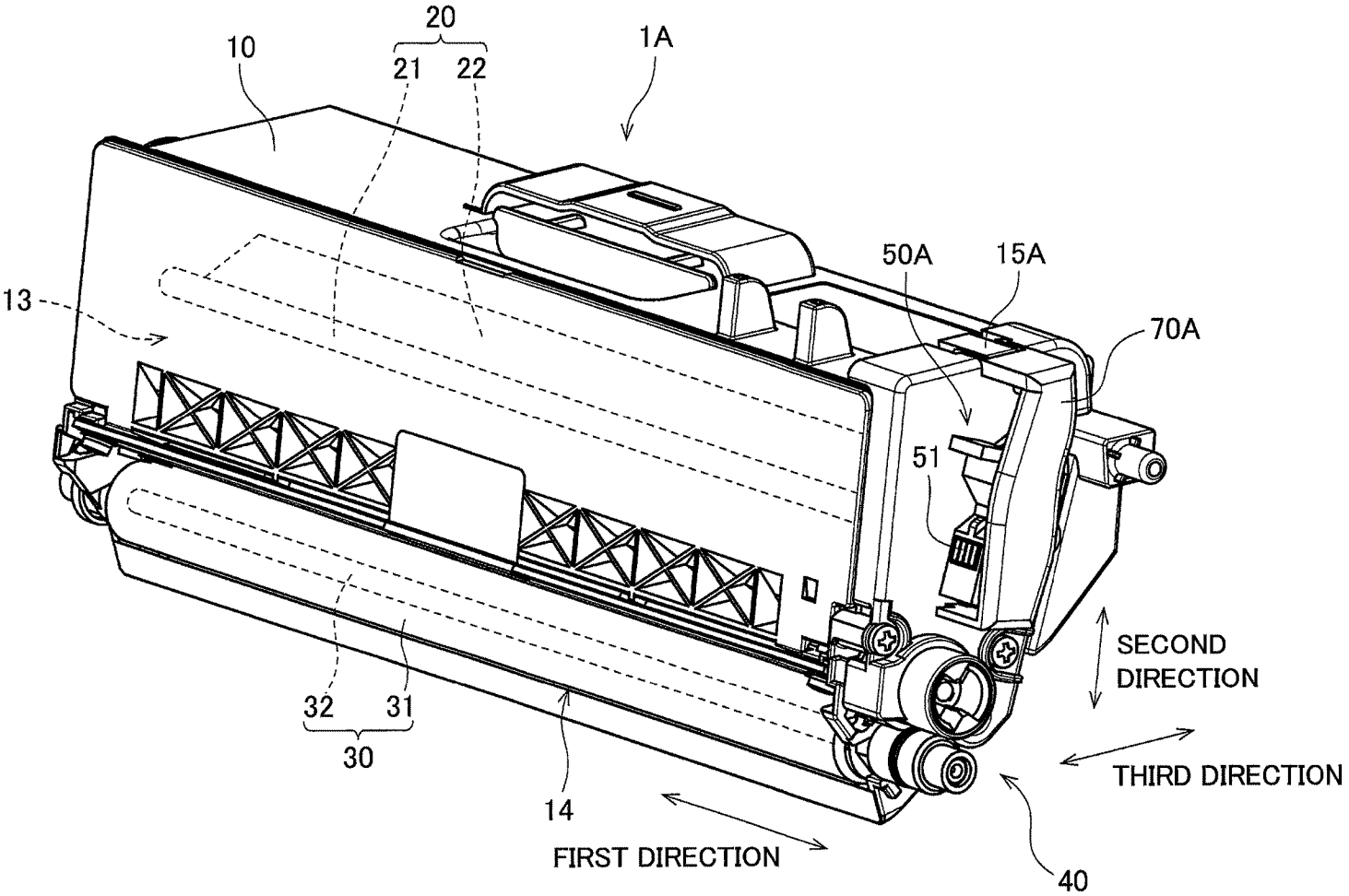
FIG. 9 is a perspective view of a developing cartridge according to a second embodiment.
Figure 10:
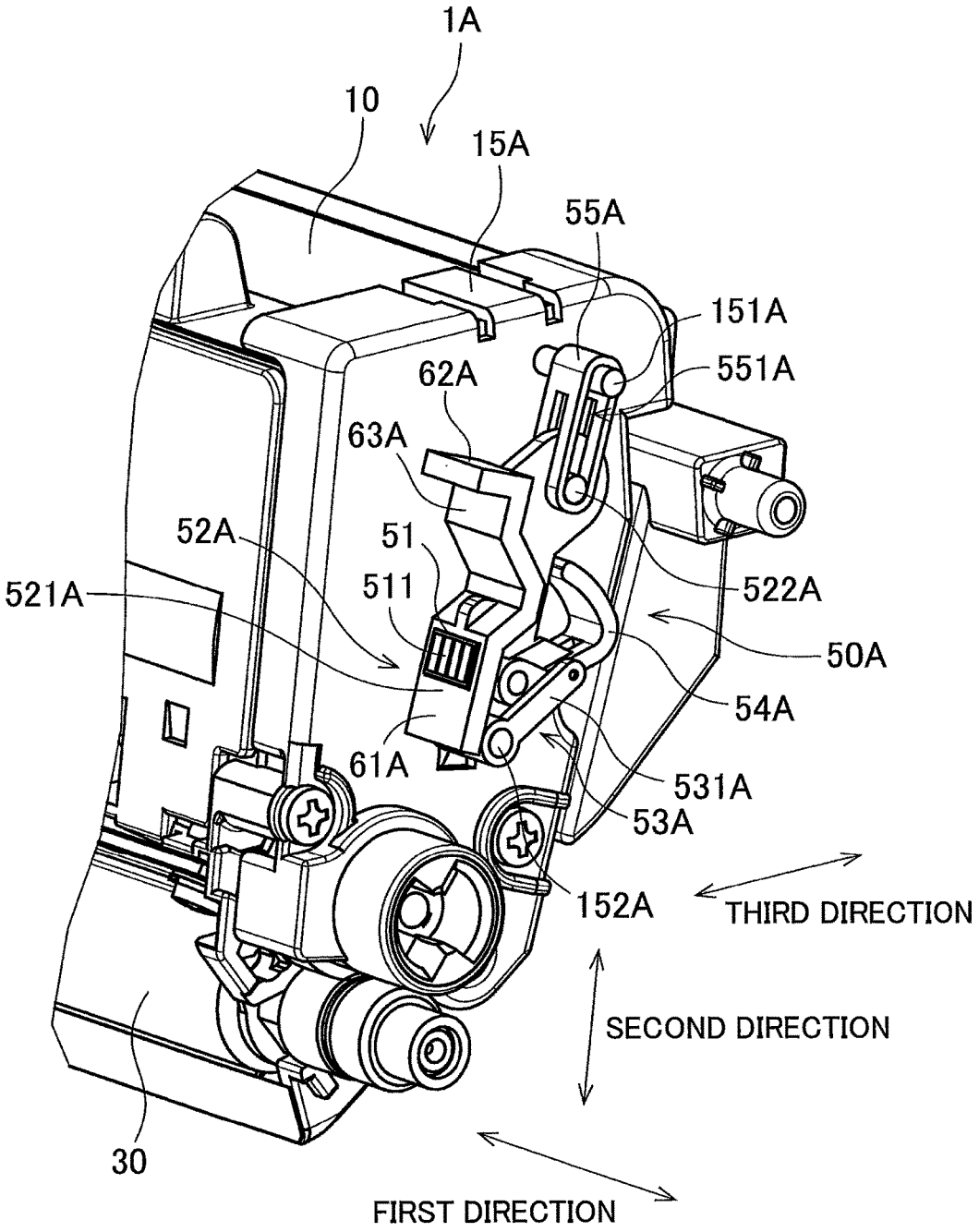
FIG. 10 is a partial perspective view of the developing cartridge according to the second embodiment.
Figure 11:
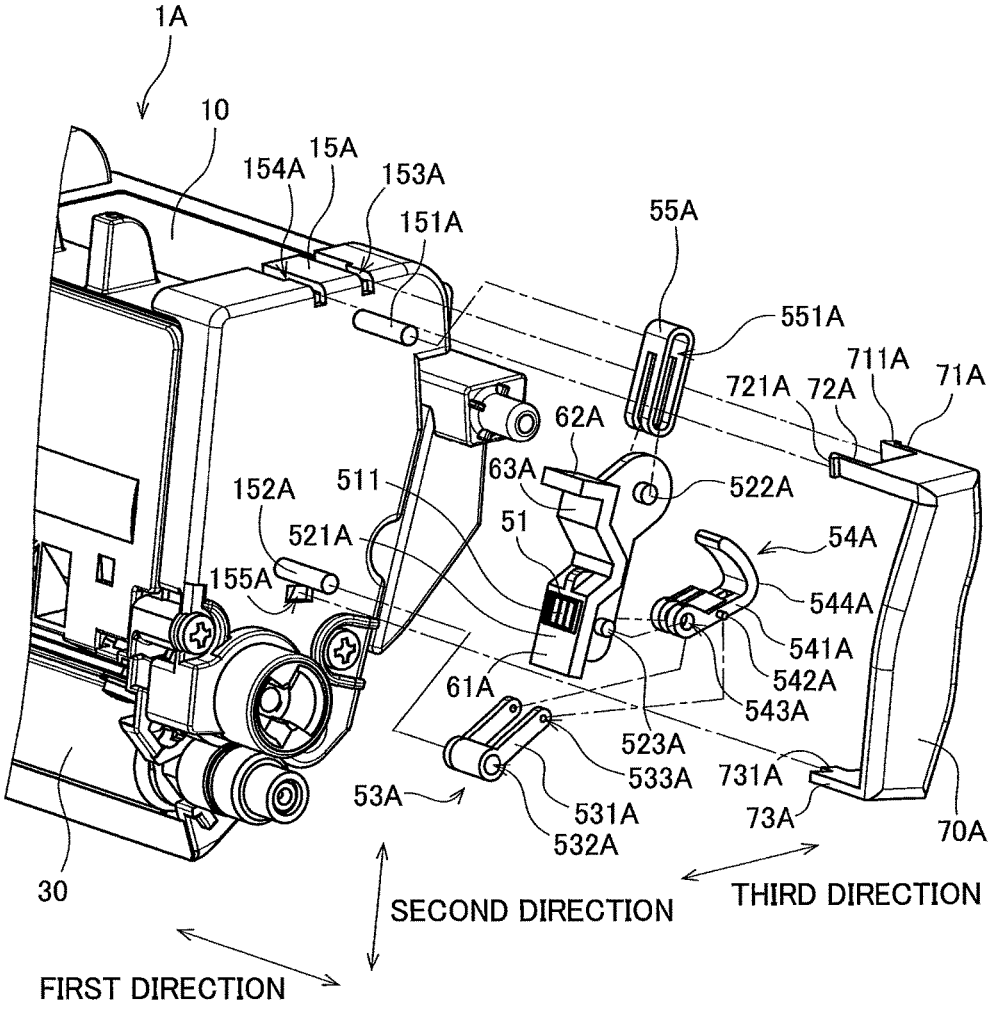
FIG. 11 is a partially exploded perspective view of the developing cartridge according to the second embodiment.
Figure 12:
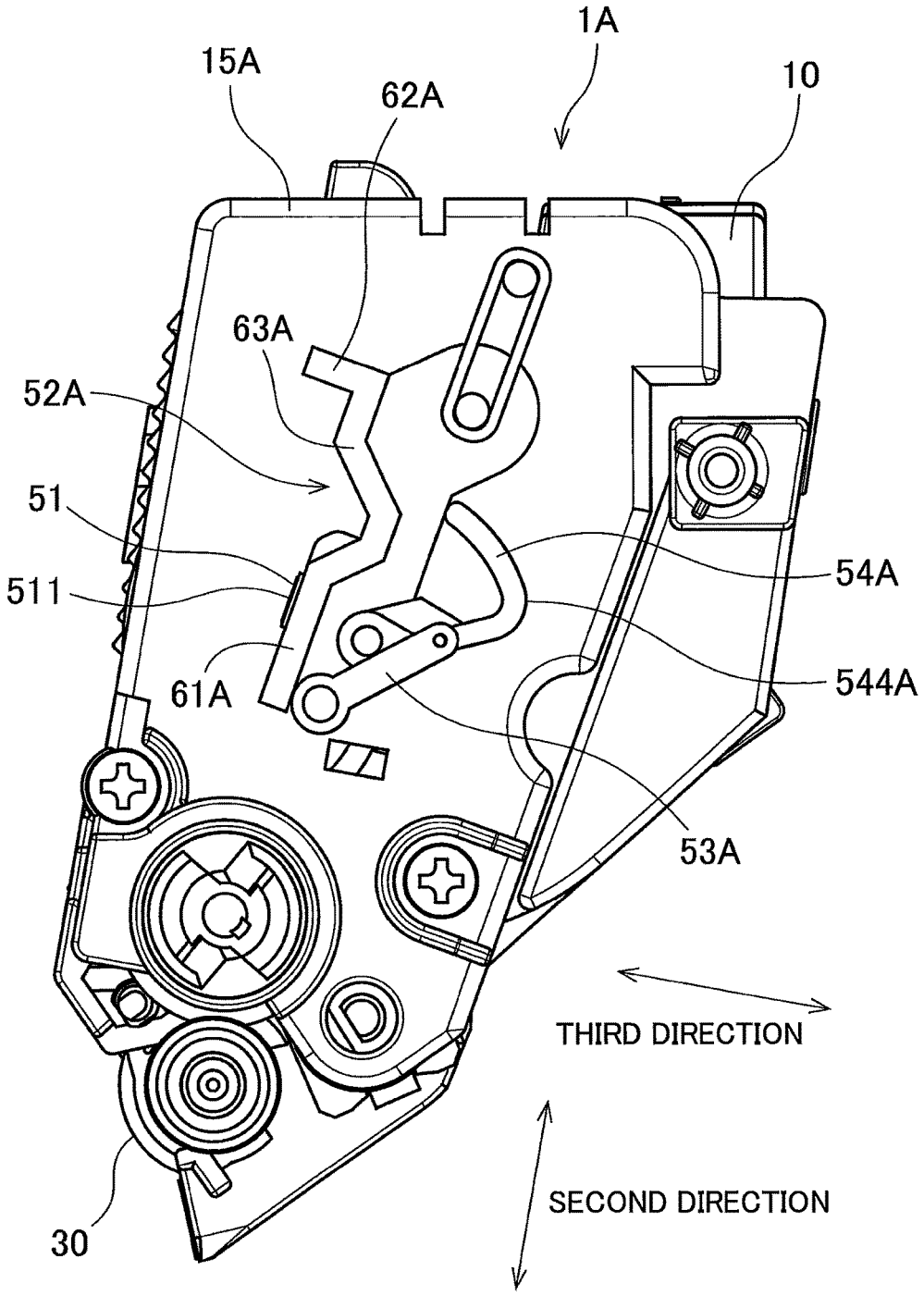
FIG. 12 is a view of the developing cartridge according to the second embodiment as viewed in a first direction.

FIG. 9 is a perspective view of the developing cartridge 1A according to the second embodiment. FIG. 10 is a partial perspective view of the developing cartridge 1A. FIG. 11 is a partially exploded perspective view of the developing cartridge 1A. FIG. 12 is a view of the developing cartridge 1A as viewed in the first direction. In FIGS. 10 and 12, a holder cover 70A to be described later is not illustrated.

As illustrated in FIGS. 9 to 12, the developing cartridge 1A according to the second embodiment includes the casing 10, agitator 20, developing roller 30, gear part 40, an IC chip assembly 50A, and the holder cover 70A. The configurations of the respective casing 10, agitator 20, developing roller 30, and gear part 40 are the same as those in the first embodiment, and duplicated descriptions thereof will be omitted.

The IC chip assembly 50A is a unit including the IC chip 51 as an example of the storage medium. The IC chip assembly 50A is positioned at one end of the casing 10 in the first direction. In the present embodiment, the IC chip assembly 50A is positioned at the outer surface of the gear cover 15A. As illustrated in FIGS. 10 and 11, the IC chip assembly 50A includes the IC chip 51, a holder 52A, a first lever 53A, a second lever 54A, and a connection lever 55A. The holder 52A, first lever 53A, second lever 54A, and connection lever 55A are separate members.

The IC chip 51 is an example of a storage medium, and the storage medium is a plate shape. The IC chip 51 stores various types of information concerning the developing cartridge 1A. As illustrated in FIG. 11, the IC chip 51 includes the electrical contact surface 511. The electrical contact surface 511 is made of metal which is an electric conductor. Correspondingly, the drawer unit includes the electrical connector 911. When the developing cartridge 1A is attached to the drawer unit, the electrical contact surface 511 of the IC chip 51 contacts the electrical connector 911.

The holder 52A includes a holding surface 521A. The holding surface 521A is an outer surface of the holder 52A at one end of the holder 52A in the third direction. The IC chip 51 is held on the holding surface 521A. For example, the IC chip 51 is fixedly secured to the holding surface 521A. The IC chip 51 may be fitted in a recessed part formed in the holding surface 521A. Alternatively, the IC chip 51 may be fixed to the holding surface 521A by an adhesive. The IC chip 51 may be configured to be slightly movable relative to the holding surface 521A. The holder 52A and the electrical contact surface 511 of the IC chip 51 need only be movable together.

The holder 52A of the present embodiment includes a holder body 61A and an engagement part 62A. The holder body 61A includes the holding surface 521A. The engagement part 62A protrudes in the third direction from such a position that is farther away from the developing roller 30 in the second direction than the holder body 61A is from the developing roller 30 in the second direction. The holder body 61A and the engagement part 62A are continuous with each other via a relay part 63A extending in the second direction. The holder body 61A, engagement part 62A, and relay part 63A are integrally formed of resin, for example.

The connection lever 55A has a connection through-hole 551A. The connection through-hole 551A penetrates the connection lever 55A in the first direction. Correspondingly, the gear cover 15A includes a cover boss 151A. The cover boss 151A extends in the first direction from the outer surface of the gear cover 15A to the connection lever 55A. The cover boss 151A is inserted into the connection through-hole 551A at one end of the connection lever 55A in a longitudinal direction thereof. Further, the holder 52A includes a holder boss 522A. The holder boss 522A extends in the first direction from the outer surface of the holder 52A toward the connection lever 55A. The holder boss 522A is inserted into the connection through-hole 551A at the other end of the connection lever 55A in the longitudinal direction thereof.

Thus, the connection lever 55A can pivotally move about the cover boss 151A relative to the casing 10. Further, the connection lever 55A can pivotally move about the holder boss 522A relative to the holder 52A.

The length of the connection through-hole 551A (inner dimension) in the longitudinal direction of the connection lever 55A is greater than the sum of the lengths of the cover boss 151A and the holder boss 522A in the longitudinal direction of the connection lever 55A.

Accordingly, in a state where the cover boss 151A is kept inserted in the connection through-hole 551A, the connection lever 55A can move in the longitudinal direction of the connection lever 55A relative to the gear cover 15A. That is, in a state where the cover boss 151A is kept inserted in the connection through-hole 551A, the connection lever 55A can move in the longitudinal direction of the connection lever 55A relative to the casing 10. Further, in a state where the holder boss 522A is kept inserted in the connection through-hole 551A, the holder 52A can move in the longitudinal direction of the connection lever 55A relative to the connection lever 55A.

Thus, the holder 52A can move in the second and third directions relative to the casing 10. When the holder 52A moves in the second direction relative to the casing 10, the electrical contact surface 511 moves together with the holder 52A in the second direction. That is, when the holder 52A moves relative to the casing 10 in the second direction, the IC chip 51 including the electrical contact surface 511 moves together with the holder 52A in the second direction. Further, when the holder 52A moves relative to the casing 10 in the third direction, the electrical contact surface 511 moves together with the holder 52A in the third direction. That is, when the holder 52A moves relative to the casing 10 in the third direction, the IC chip 51 including the electrical contact surface 511 moves together with the holder 52A in the third direction.

The connection lever 55A may have a recessed part into which the cover boss 151A is inserted, in place of the connection through-hole 551A. Further, the gear cover 15A may have a through-hole or a recessed part. The connection lever 55A may have a boss extending in the first direction toward the gear cover 15A. The boss of the connection lever 55A may be inserted into the through-hole or recessed part of the gear cover 15A.

The connection lever 55A may have a recessed part into which the holder boss 522A is inserted, in place of the connection through-hole 551A. Further, the holder 52A may have a through-hole or a recessed part. The connection lever 55A may have a boss extending in the first direction toward the holder 52A. The boss of the connection lever 55A may be inserted into the through-hole or recessed part of the holder 52A.

The first lever 53A is positioned between the developing roller 30 and the second lever 54A in the second direction. Further, the first lever 53A is positioned at the side opposite to the holding surface 521A relative to the holder body 61A in the third direction. The first lever 53A has a first arm part 531A, a first through-hole 532A, and a third through-hole 533A. The first through-hole 532A is positioned at one end portion of the first arm part 531A. The first through-hole 532A penetrates the first lever 53A in the first direction. The third through-hole 533A is positioned at the other end portion of the first arm part 531A. The gear cover 15A includes a first boss 152A (an example of the shaft). The first boss 152A extends in the first direction from the outer surface of the gear cover 15A toward the first lever 53A. The first boss 152A is inserted in the first through-hole 532A. The first lever 53A can pivotally move about the center axis of the first boss 152 (an example of the second axis). With this configuration, the first lever 53A can pivotally move between the third and fourth positions (to be described later) relative to the casing 10.

The first lever 53A may have a recessed part into which the first boss 152A is inserted, in place of the first through-hole 532A. Further, the gear cover 15A may have a through-hole or a recessed part. The first lever 53A may have a boss extending in the first direction toward the gear cover 15A. The boss of the first lever 53A may be inserted into the through-hole or recessed part of the gear cover 15A.

The second lever 54A is positioned at the side opposite to the developing roller 30 relative to the first lever 53A in the second direction. Further, the second lever 54A is positioned at the side opposite to the holding surface 521A relative to the holder body 61A in the third direction. The second lever 54A has a second arm part 541A, a second boss 542A, and a second through-hole 543A.

The second boss 542A is positioned between opposite end portions of the second arm part 541A, wherein the opposite end portions including: one end portion that is farther from the electrical contact surface 511 than the other end portion is from the electrical contact surface 511; and the other end portion that is closer to the electrical contact surface 511 than the one end portion is to the electrical contact surface 511. The second boss 542A extends in the first direction. The second boss 542A is fitted in the third through-hole 533A. With this configuration, the other end portion of the first lever 53A and the second lever 54 are connected to each other such that the second lever 54A can pivotally move about the second boss 542A relative to the first lever 53A.

The first lever 53A may have a recessed part into which the second boss 542A is inserted, in place of the third through-hole 533A. Further, the second lever 54A may have a through-hole or a recessed part. The first lever 53A may have a boss extending in the first direction toward the second lever 54A. The boss of the first lever 53A may be inserted into the through-hole or recessed part of the second lever 54A.

The second through-hole 543A is positioned at the other end portion of the second arm part 541A. The second through-hole 543A penetrates the second lever 54A in the first direction. The holder 52A includes a third boss 523A. The third boss 523A is positioned at an end portion of the holder 52A in the third direction at the side opposite to the holding surface 521 of the holder body 61A. The third boss 523A extends in the first direction. The third boss 523A is inserted into the second through-hole 543A. With this configuration, the other end portion of the second lever 54A is connected to the holder 52A such that the second lever 54A can pivotally move about the center axis of the third boss 523A (an example of the third axis) relative to the holder 52A.

The second lever 54A may have a recessed part into which the third boss 523A is inserted, in place of the second through-hole 543A. Further, the holder 52A may have a through-hole or a recessed part. The second lever 54A may have a boss extending in the first direction toward the holder 52A. The boss of the second lever 54A may be inserted into the through-hole or recessed part of the holder 52A.

In this way, the second lever 54A is connected to both of the first lever 53A and the holder 52A so as to be pivotally movable relative to both of the first lever 53A and the holder 52A. Thus, the second lever 54A can move together with the holder 52A relative to the casing 10. Further, the second lever 54A can pivotally move between fifth and sixth positions to be described later relative to the first lever 53A.

Further, the second lever 54A includes a guide surface 544A. The guide surface 544A is the outer surface of the second lever 54A positioned at one end portion thereof. The guide surface 544A is a sloped surface that is inclined relative to the second direction such that the guide surface 544A approaches the holding surface 521A as proceeding toward the developing roller 30. The guide surface 544A of the present embodiment is curved in an arc shape centered on the third boss 523A.

The holder cover 70A is fixed to the gear cover 15A. The gear cover 15A has a first engagement hole 153A, a second engagement hole 154A, and a third engagement hole 155A. The first to third engagement holes 153A to 155A penetrate the gear cover 15A in the first direction.

The holder cover 70A includes a first protruding part 71A, a second protruding part 72A, and a third protruding part 73A. The first through third protruding parts 71A to 73A extend in the first direction from the holder cover 70A toward the gear cover 15A. A distal end of the first protruding part 71A includes a first pawl 711A protruding in a direction crossing the first direction. A distal end of the second protruding part 72A includes a second pawl 721A protruding in a direction crossing the first direction. A distal end of the third protruding part 73A includes a third pawl 731A protruding in the first direction.

The first pawl 711A engages with the first engagement hole 153A. The second pawl 721A engages with the second engagement hole 154A. The third pawl 731A engages with the third engagement hole 155A. With this configuration, the holder cover 70A is fixed to the gear cover 15A. That is, the holder cover 70A is fixed to the first end face 11 of the casing 10 via the gear cover 15A. At least a portion of the IC chip assembly 50A is covered by the holder cover 70A. That is, at least a portion of the IC chip assembly 50A is positioned between the gear cover 15A and the holder cover 70A.

<2-2. Insertion Operation>

Figure 13:
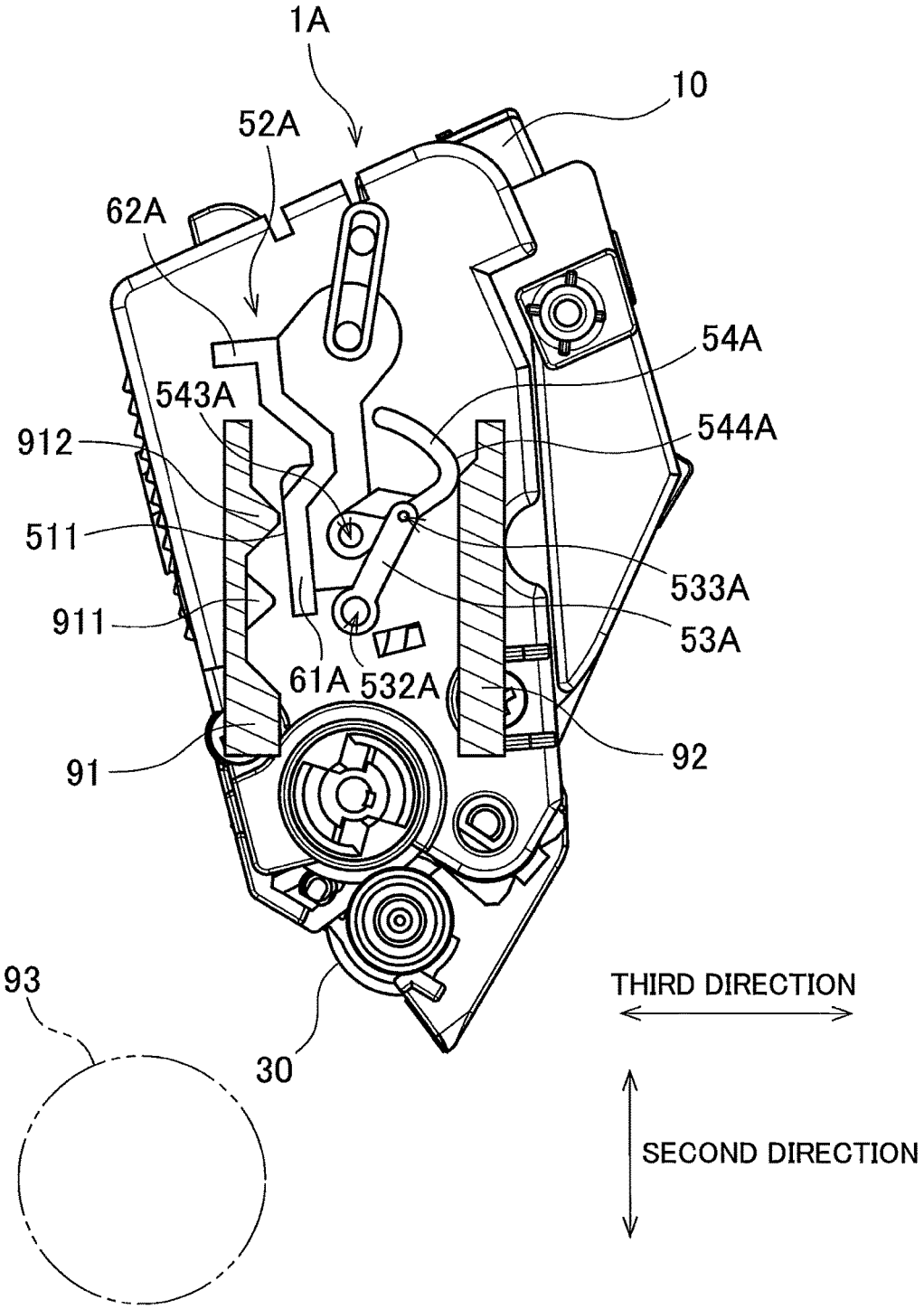
FIG. 13 is a view illustrating a state of the developing cartridge according to the second embodiment during an insertion operation thereof.
Figure 14:
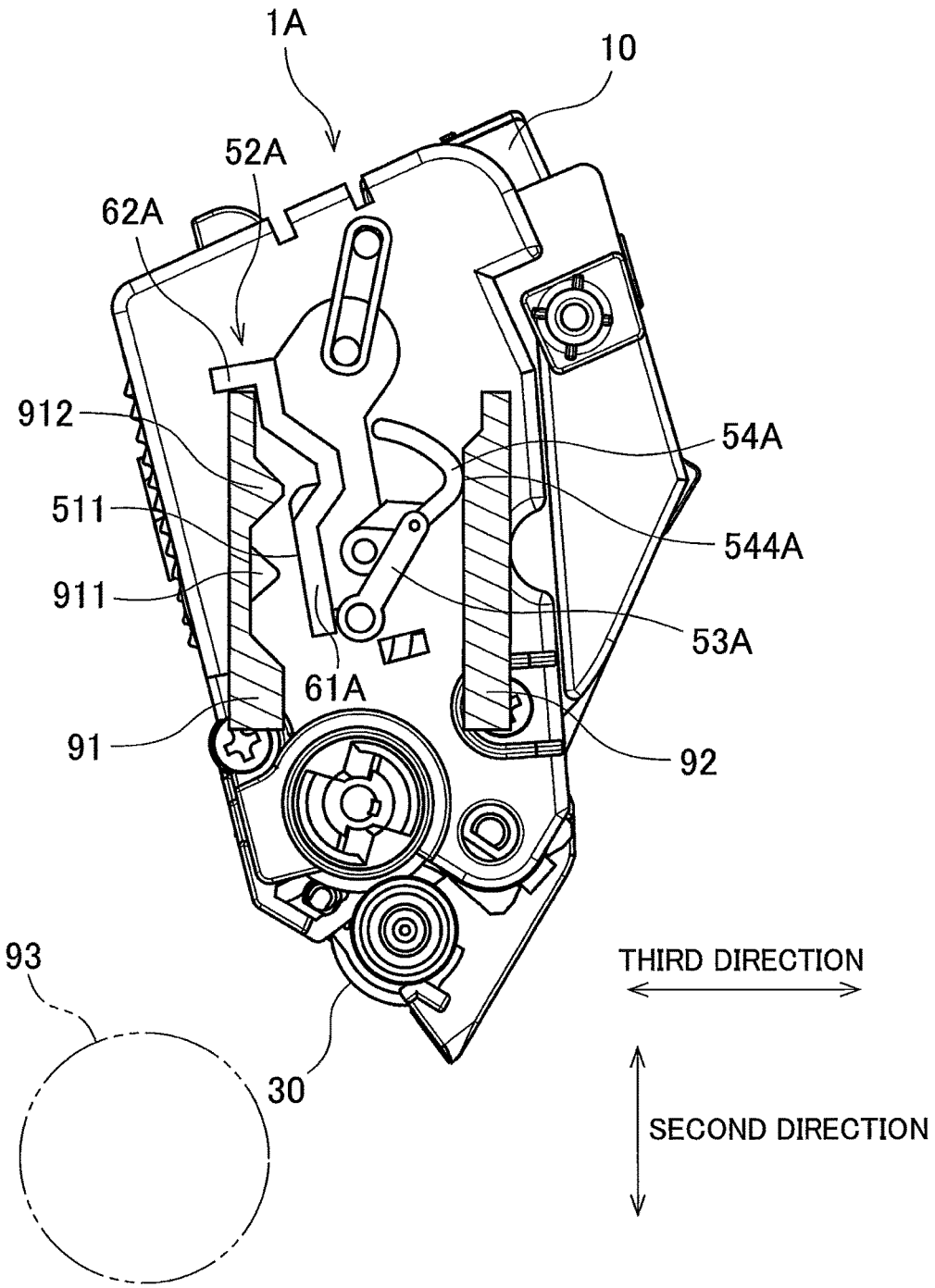
FIG. 14 is a view illustrating a state of the developing cartridge according to the second embodiment during the insertion operation thereof.
Figure 15:
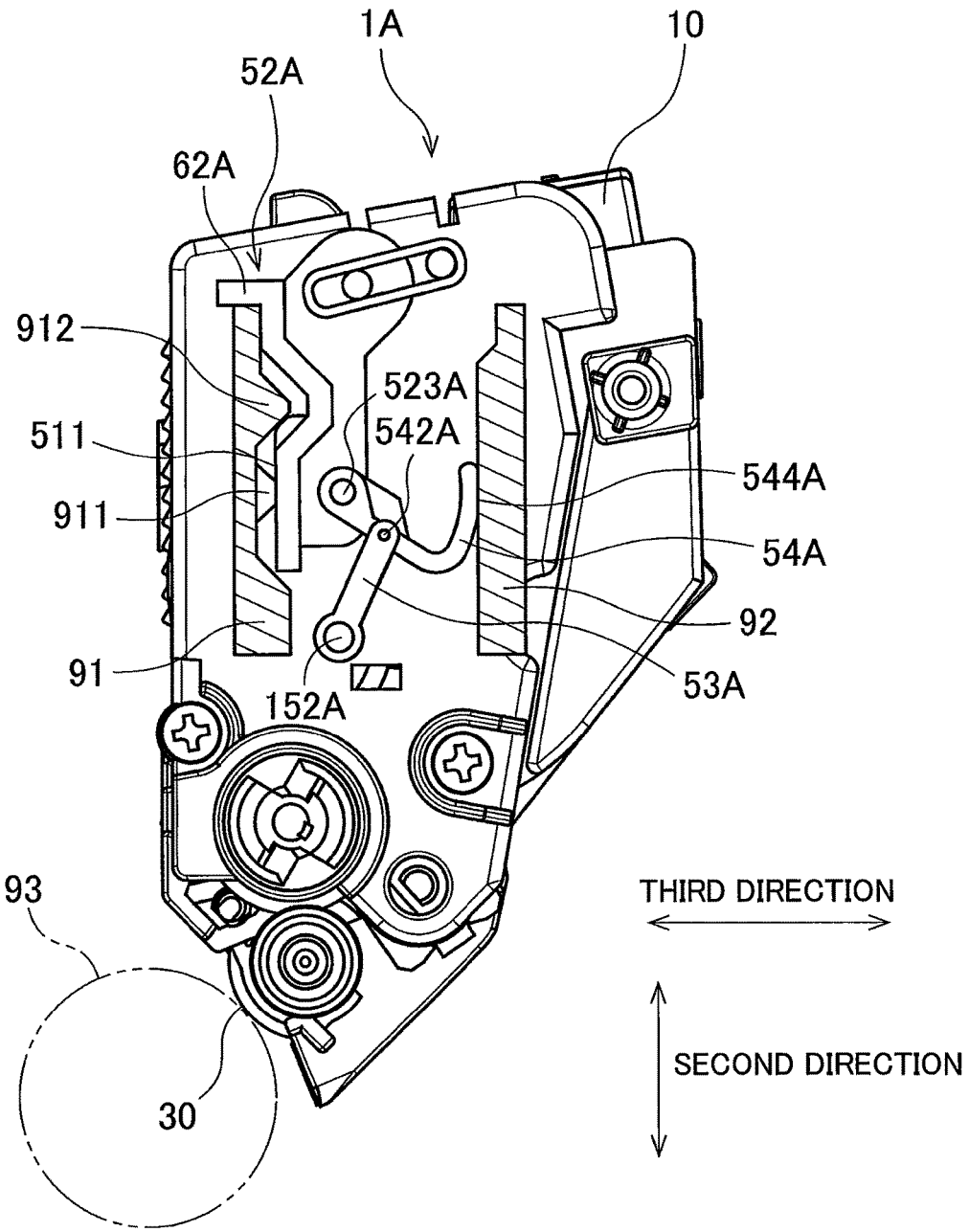
FIG. 15 is a view illustrating a state of the developing cartridge according to the second embodiment during the insertion operation thereof.

Next will be described an insertion operation of the developing cartridge 1A into the drawer unit. FIGS. 13 to 15 are views illustrating states where the developing cartridge 1A is inserted into the drawer unit. The drawer unit has the first and second guide plates 91 and 92 which are the same as those in the first embodiment.

At the time of insertion of the developing cartridge 1A into the drawer unit, first, the holder body 61A, first lever 53A, and second lever 54A are inserted into the space between the first and second guide plates 91 and 92, as illustrated in FIG. 13. In the state illustrated in FIG. 13, the engagement part 62A has not yet contacted the first guide plate 91. At this time, the holder body 61A contacts the guide protrusion 912 of the first guide plate 91. The guide surface 544A of the second lever 54A contacts the second guide plate 92. As a result, the first lever 53A becomes positioned at the third position relative to the casing 10, and the second lever 54A becomes positioned at the fifth position relative to the first lever 53A.

The orientation of the first lever 53A is closer to a direction parallel to the second direction when the first lever 53A is at the third position to be described later than when the first lever 53A is at the fourth position. Specifically, a direction, in which the first through-hole 532A and the third through-hole 533A are arranged when the first lever 53A is at the third position, is closer to the second direction than a direction, in which the first through-hole 532A and the third through-hole 533A are arranged when the first lever 53A is at the fourth position, is to the second direction. The second lever 54A at the fifth position is inclined relative to the third direction. Specifically, in the second direction, the guide surface 544A is more apart from the developing roller 30 than the second through-hole 543A is from the developing roller 30.

In this state, the second lever 54A includes a pair of opposite end portions in the third direction, and a length in the third direction between the electrical contact surface 511 and one of the opposite end portions that is farther away from the electrical contact surface 511 than the remaining one of the opposite end portions is from the electrical contact surface 511, is equal to a first length. The first length is equal to or smaller than the interval between the guide protrusion 912 and the second guide plate 92 in the third direction. Accordingly, the IC chip 51, holder body 61A, first lever 53A, and second lever 54A pass through the space between the guide protrusion 912 and the second guide plate 92.

After the IC chip 51 passes by the guide protrusion 912, the engagement part 62A contacts the first guide plate 91, as illustrated in FIG. 14. Specifically, the engagement part 62A contacts one of the opposite end portions of the first guide plate 91 in the second direction that is farther away from the photosensitive drum 93 than the other one of the opposite end portions is from the photosensitive drum 93. Thus, the engagement part 62A is brought into engagement with the first guide plate 91. As a result, the holder 52A is fixed in position relative to the first guide plate 91 in the second direction.

Subsequently, from the state illustrated in FIG. 14, the casing 10 is further inserted toward the photosensitive drum 93 in the second direction. As a result, the casing 10 moves toward the photosensitive drum 93 relative to the holder 52A as illustrated in FIG. 15 in a state in which the position of the holder 52A relative to the first and second guide plates 91 and 92 in the second position is kept fixed.

As a result, the first lever 53A receives, from the first boss 152A, such pressure that is directed toward the photosensitive drum 93 in the second direction. Accordingly, the first lever 53A pulls the second boss 542A of the second lever 54A toward the photosensitive drum 93 while pivotally moving from the third position to the fourth position. This causes the second lever 54A to pivotally move about the third boss 523A. That is, the second lever 54A is pivotally moved by a force transmitted from the casing 10 via the first lever 53A. As a result, the second lever 54A moves from the fifth position to the sixth position relative to the first lever 53A.

When the second lever 54A becomes positioned at the sixth position, the contact position between the guide surface 544A of the second lever 54A and the second guide plate 92 become aligned with the third boss 523A in the third direction. As a result, the holder 52A moves in the third direction toward the first guide plate 91. That is, the holder 52A moves relative to the casing 10 from the first position to the second position in the third direction. At this time, the length in the third direction between the electrical contact surface 511 and the one end portion of the second lever 54A in the third direction that is farther away from the electrical contact surface 511 than the other end portion of the second lever 54A in the third direction is from the electrical contact surface 511, becomes equal to a second length that is greater than the first length, thereby bringing the electrical contact surface 511 of the IC chip 51 into contact with the electrical connector 911. As a result, the electrical contact surface 511 and the electrical connector 911 become electrically conducted to each other, thereby allowing the image forming apparatus to perform at least one of reading and writing operations of information from/into the IC chip 51.

As described above, in the developing cartridge 1A of the present embodiment, the first lever 53A and the second lever 54A move at the time of insertion of the developing cartridge 1A into the drawer unit. In association with the movement of the first and second levers 53A and 54A, the electrical contact surface 511 moves together with the holder 52A in the third direction. As a result, the electrical contact surface 511 contacts the electrical connector 911. Thus, the developing cartridge 1A can be inserted into the drawer unit while suppressing rubbing of the electrical contact surface 511.

<2-3. Separation Operation>

Figure 16:
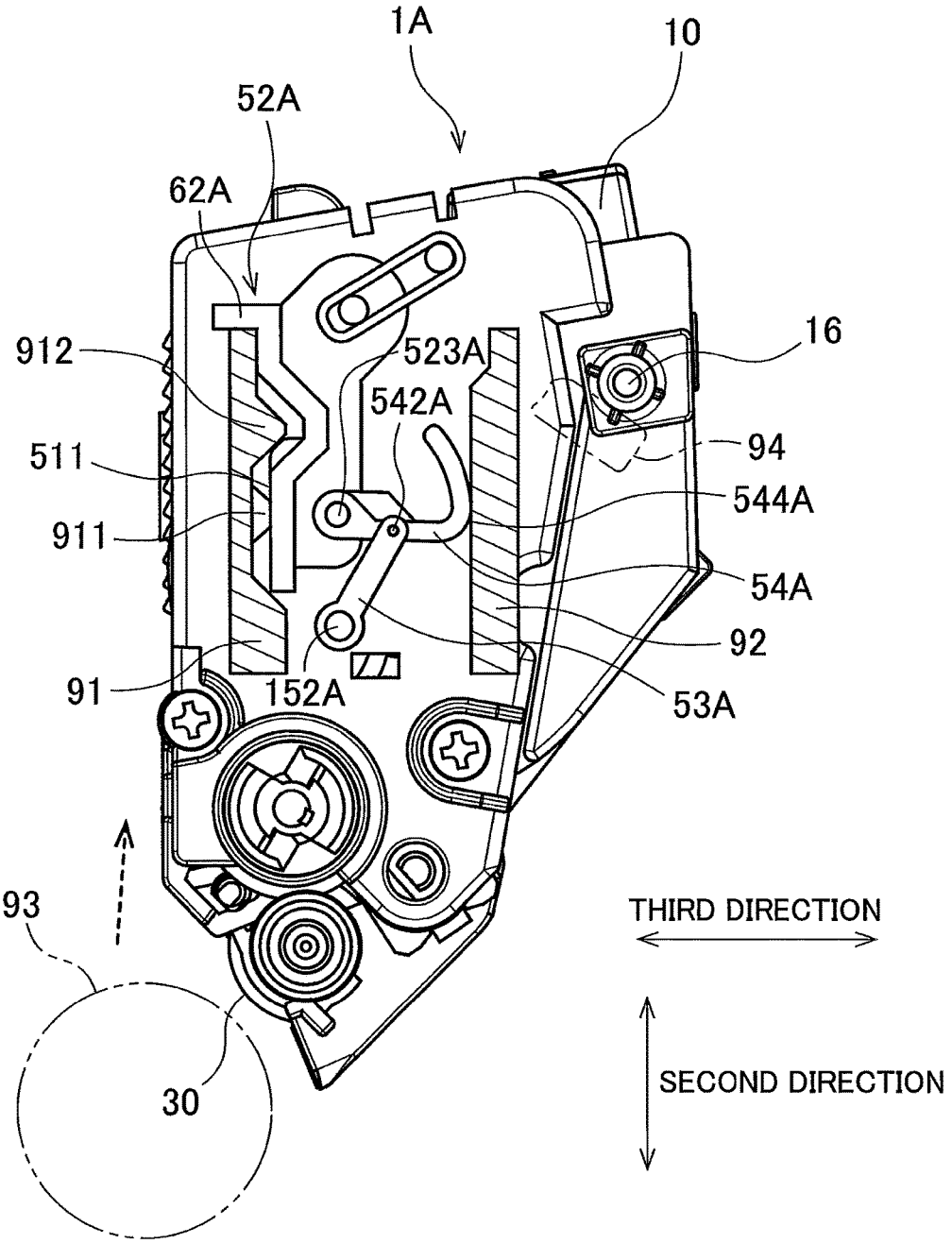
FIG. 16 is a view illustrating a state of the developing cartridge according to the second embodiment during a separation operation thereof.

After completion of the above-described insertion operation, the image forming apparatus can perform the so-called "separation operation" of temporarily separating the developing roller 30 from the photosensitive drum 93. Next will be described the separation operation. FIG. 16 is a view illustrating a state where the separation operation is performed.

At the time of the separation operation, a pressing lever (not illustrated) of the drawer unit is pressed by drive force from the image forming apparatus. As a result, the separation member 94 constituting the drawer unit moves in a direction away from the photosensitive drum 93. The separation member 94 contacts the protrusion 16 to press the protrusion 16 in a direction away from the photosensitive drum 93. As a result, as denoted by the dashed arrow in FIG. 16, the casing 10 and developing roller 30 of the developing cartridge 1A move in the second direction relative to the drawer unit. The developing roller 30 and the photosensitive drum 93 become separated from each other.

The position of the holder 52A relative to the drawer unit is not changed over the time from before the separation operation is started and until after the separation operation is completed. That is, the casing 10 moves relative to the holder 52A in a direction away from the photosensitive drum 93 in a state in which the position of the holder 52A relative to the first guide plate 91 and second guide plate 92 in the second direction is kept fixed.

As a result, the first lever 53A receives, from the first boss 152A, such pressure that is directed away from the photosensitive drum 93 in the second direction. As a result, the first lever 53A pivotally moves from the fourth position toward the third position. The first lever 53A presses the second boss 542A of the second lever 54A in a direction away from the photosensitive drum 93, with the result that the second lever 54A pivotally moves about the third boss 523A. That is, the second lever 54A is pivotally moved by a force transmitted from the casing 10 via the first lever 53A. As a result, the second lever 54A moves relative to the first lever 53A from the sixth position to a seventh position that is disposed between the fifth position and the sixth position.

When the second lever 54A is at the sixth position or the seventh position, the guide surface 544A of the second lever 54A is positioned at the one end portion of the second lever 54A in the third direction that is farther away from the electrical contact surface 511 than the other end portion of the second lever 54A in the third direction is from the electrical contact surface 511. Further, the guide surface 544A is curved in an arc shape that is centered on the third boss 523A. Accordingly, even when the second lever 54A pivotally moves from the sixth position to the seventh position, the length in the third direction between the electrical contact surface 511 and the contact position between the guide surface 544A and the second guide plate 92 is unchanged from the second length. This ensures that the electrical contact surface 511 is maintained in contact with the electrical connector 911 over the time from before the separation operation is started and until after the separation operation is completed. As a result, rubbing of the electrical contact surface 511 can be suppressed during the separation operation.

Further, in the above-described embodiment, both of the insertion direction, in which the developing cartridge 1A is inserted into the drawer unit, and the separation direction, in which the developing roller 30 is separated away from the photosensitive drum 93 during the separation operation, coincide with the second direction. However, the insertion direction and the separation direction may differ from each other. Each of the insertion direction and the separation direction only needs to cross the first direction.

3. Modifications

While the first and second embodiments have been described, the present disclosure is not limited to the above-described embodiments.

Figure 17:
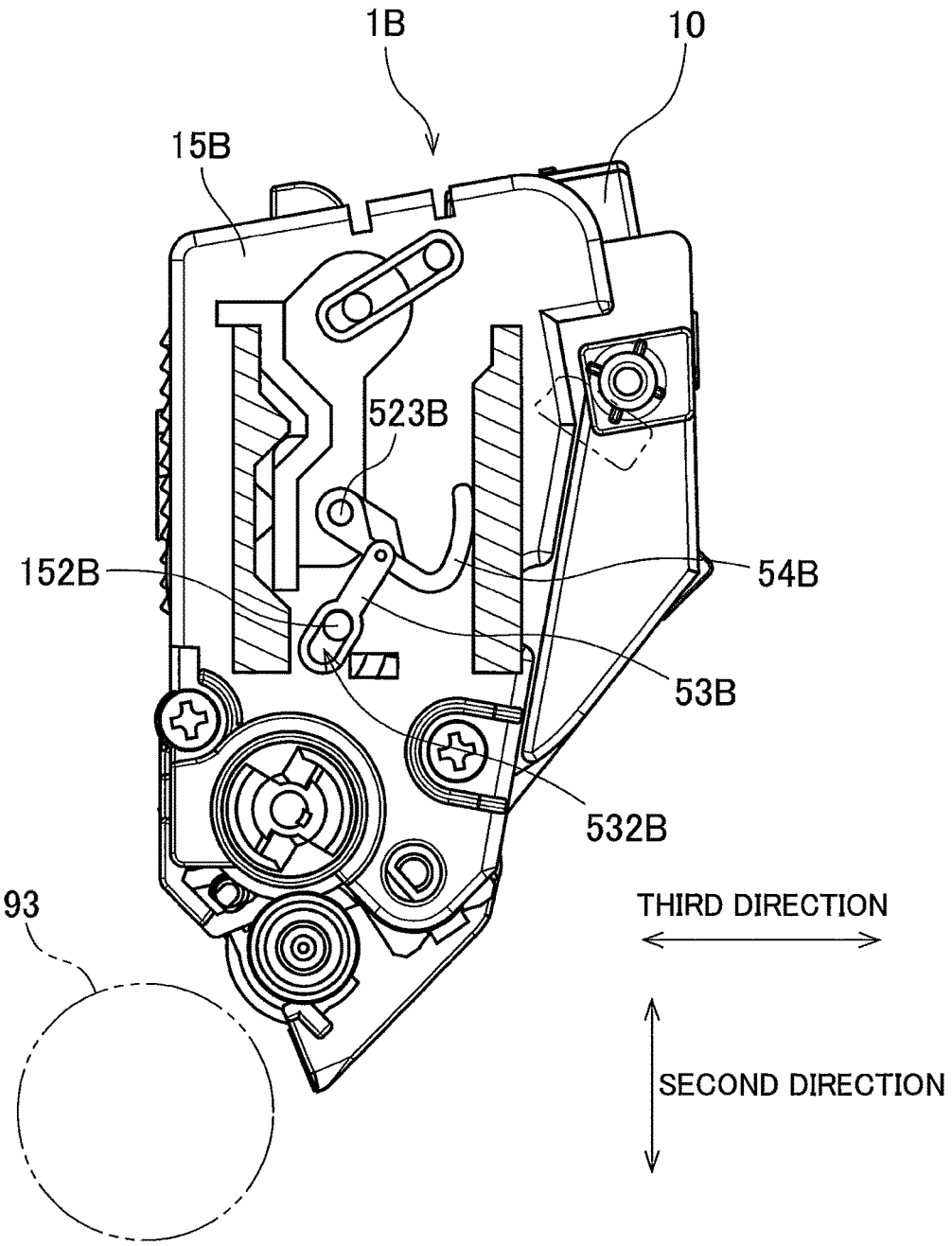
FIG. 17 is a view of a developing cartridge according to a first modification as viewed in the first direction.

FIG. 17 is a view of a developing cartridge 1B according to a first modification as viewed in the first direction. The developing cartridge 1B of FIG. 17 differs from the developing cartridge 1A of the second embodiment in the shape of a first through-hole 532B of a first lever 53B. Specifically, the length of the first through-hole 532B of the first lever 53B (inner dimension) in the second direction is greater than the length of a first boss 152B (outer dimension) in the second direction. Accordingly, the first lever 53B can move in the second direction relative to the first boss 152B. That is, the first lever 53B can move in the second direction relative to the casing 10.

During the separation operation, the casing 10 moves in the second direction relative to the first lever 53B, with the first boss 152B being kept inserted in the first through-hole 532B. Accordingly, the separation operation can be performed without pivotally moving a second lever 54B about a third boss 523B. In this way, the separation operation may be performed utilizing a dimensional difference between the first boss 152B and the first through-hole 532B.

The first lever 53B may have a recessed part into which the first boss 152B is inserted, in place of the first through-hole 532B. In this case, the length of the recessed part of the first lever 53B (inner dimension) in the second direction is made greater than the length of the first boss 152B (outer dimension) in the second direction.

Further, a gear cover 15B may have a through-hole or a recessed part. The first lever 53B may have a boss extending in the first direction toward the gear cover 15B. The boss of the first lever 53B may be inserted into the through-hole or recessed part of the gear cover 15B. In this case, the length of the through-hole or recessed part of the gear cover 15B (inner dimension) in the second direction is made greater than the length of the boss of the first lever 53B (outer dimension) in the second direction.

Figure 18:
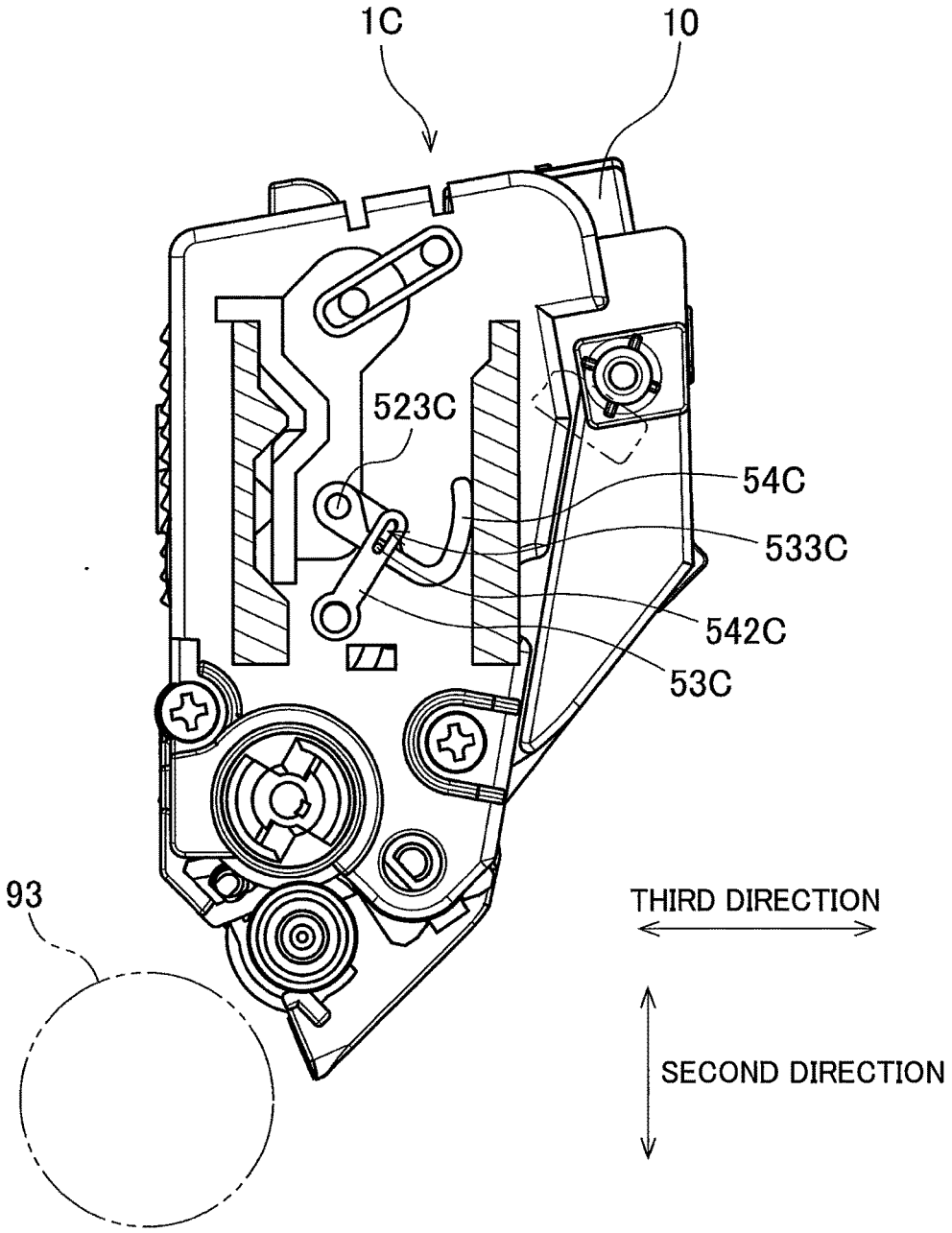
FIG. 18 is a view of a developing cartridge according to a second modification as viewed in the first direction.

FIG. 18 is a view of a developing cartridge 1C according to a second modification as viewed in the first direction. The developing cartridge 1C of FIG. 18 differs from the developing cartridge 1A of the second embodiment in the shape of a third through-hole 533C of a first lever 53C. Specifically, the length of the third through-hole 533C of the first lever 53C (inner dimension) in the second direction is greater than the length of a second boss 542C (outer dimension) in the second direction. Accordingly, the second lever 54C can move in the second direction relative to a first lever 53C. That is, the second lever 54C can move in the second direction relative to both of the casing 10 and the first lever 53C.

During the separation operation, the casing 10 and first lever 53C move in the second direction relative to the second lever 54C, with the second boss 542C being kept inserted in the third through-hole 533C. Accordingly, the separation operation can be performed without pivotally moving the second lever 54C about a third boss 523C. In this manner, the separation operation may be performed utilizing a dimensional difference between the second boss 542C and the third through-hole 533C.

The first lever 53C may have a recessed part into which the second boss 542C is inserted, in place of the third through-hole 533C. In this case, the length of the recessed part of the first lever 53C (inner dimension) in the second direction is made greater than the length of the second boss 542C (outer dimension) in the second direction.

Further, the second lever 54C may have a through-hole or a recessed part. The first lever 53C may have a boss extending in the first direction toward the second lever 54C. The boss of the first lever 53C may be inserted into the through-hole or recessed part of the second lever 54C. In this case, the length of the through-hole or recessed part of the second lever 54C (inner dimension) in the second direction is made greater than the length of the boss of the first lever 53C (outer dimension) in the second direction.

Figure 19:
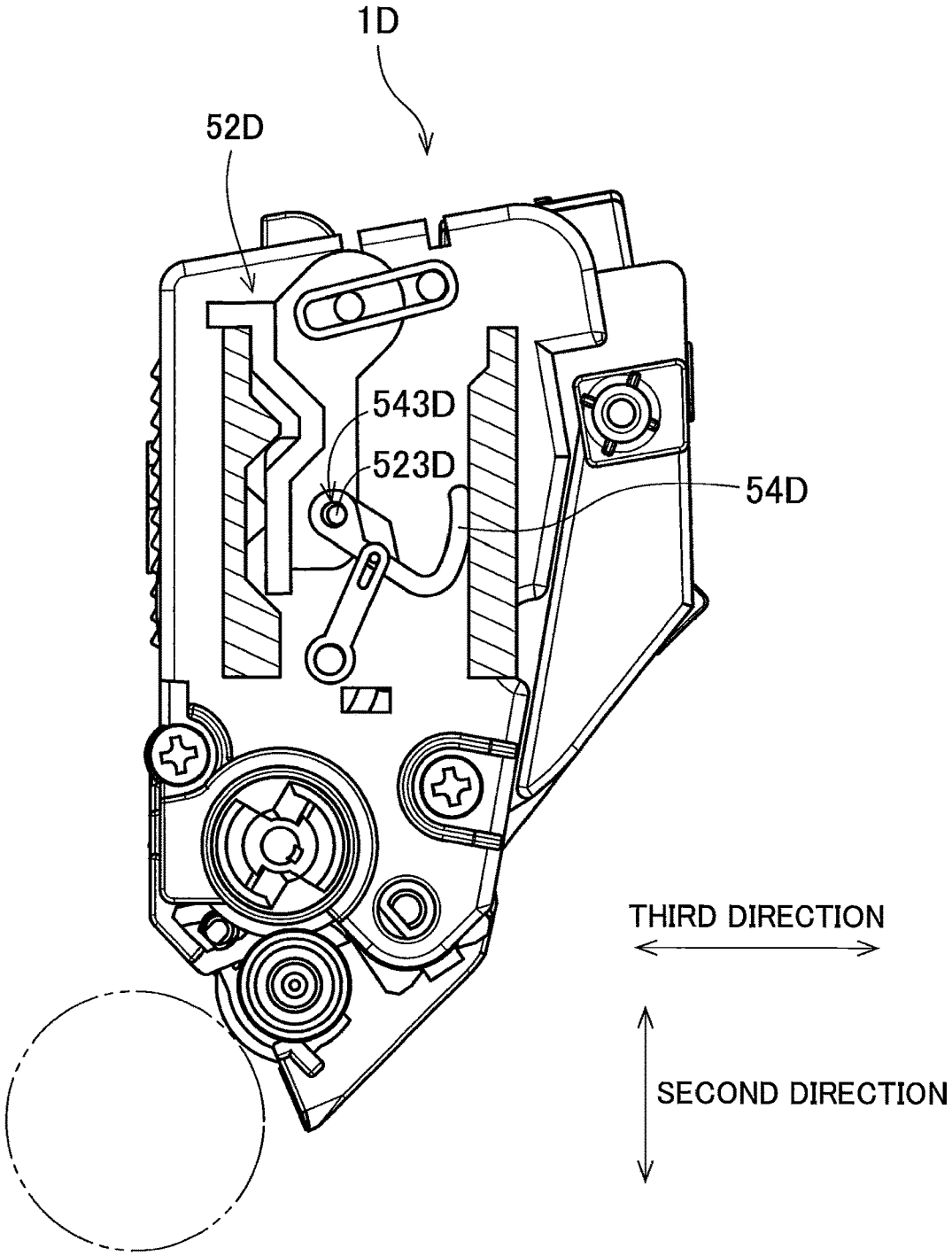
FIG. 19 is a view of a developing cartridge according to a third modification as viewed in the first direction.

FIG. 19 is a view of a developing cartridge 1D according to a third modification as viewed in the first direction. The developing cartridge 1D of FIG. 19 differs from the developing cartridge 1C of FIG. 18 in the shape of a second through-hole 543D of a second lever 54D. Specifically, the diameter of the second through-hole 543D of the second lever 54D (inner diameter) is greater than the diameter of a third boss 523D (outer diameter). Accordingly, the third boss 523D can move in the second or third direction inside the second through-hole 543D. Accordingly, the pivot center of the second lever 54D slightly moves in accordance with change in the position of the third boss 523D inside the second through-hole 543D. In this way, a gap may be formed between the second through-hole 543D and the third boss 523D.

The second lever 54D may have a recessed part into which the third boss 523D is inserted, in place of the second through-hole 543D. In this case, the diameter of the recessed part of the second lever 54D (inner diameter) may be greater than the diameter of the third boss 523D (outer diameter).

Further, a holder 52D may have a through-hole or a recessed part. The second lever 54D may have a boss extending in the first direction toward the holder 52D. The boss of the second lever 54D may be inserted into the through-hole or recessed part of the holder 52D. In this case, the diameter of the through-hole or recessed part of the holder 52D (inner diameter) may be greater than the diameter of the boss of the second lever 54D (outer diameter).

Further, in the above-described embodiments, the IC chip including the electric contact surface is fixed to the holding surface of the holder. However, a configuration may be adopted, in which only the electric contact surface of the IC chip that contacts the electric connector is fixed to the holding surface of the holder, and portions of the IC chip other than the electric contact surface are positioned at other portions of the developing cartridge.

The first and second directions need not be perpendicular to each other. The second and third directions need not be perpendicular to each other. Further, the first and third directions need not be perpendicular to each other.

The detailed shape of the developing cartridge may differ from that illustrated in the drawings of the present disclosure. Further, the elements exemplified in the above-described embodiments and modifications may be assembled appropriately in a range where consistency is maintained.

While the description has been made in detail with reference to the specific embodiments and modifications thereof, it would be apparent to those skilled in the art that various changes and modifications may be made therein without departing from the spirit and scope of the above described aspects.

What is claimed is:

1. A developing cartridge comprising:

a casing configured to accommodate therein developing agent;

a developing roller rotatable about a first axis extending in a first direction, the developing roller being positioned at one end portion of the casing defined in a second direction;

a storage medium including an electric contact surface;

a holder positioned at one end of the casing in the first direction, and movable relative to the casing between a first position and a second position in a third direction crossing the electric contact surface, the holder having one end portion in the third direction, the one end portion holding the electric contact surface;

a first lever positioned at the one end of the casing in the first direction, and movable relative to the casing between a third position and a fourth position about a second axis extending in the first direction; and a second lever movable together with the holder relative to the casing, the second lever being movable between a fifth position and a sixth position relative to the first lever;

wherein the holder is at the first position in a case where the second lever is at the fifth position, and wherein the holder is at the second position in a case where the second lever is at the sixth position.

2. The developing cartridge according to claim 1, wherein the second direction crosses the first direction.

3. The developing cartridge according to claim 1, wherein the holder includes an outer surface at the one end portion, and the outer surface holds the electric contact surface.

4. The developing cartridge according to claim 1, wherein the first lever is movable between the third position and the fourth position about a shaft extending from an outer surface of the casing along the second axis.

5. The developing cartridge according to claim 1, wherein, in a case where the second lever is at the fifth position, a length in the third direction, between the electric contact surface and one of a pair of opposite end portions of the second lever in the third direction that is farther away from the electric contact surface than a remaining one of the pair of opposite end portions is from the electric contact surface, is a first length, wherein, in a case where the second lever is at the sixth position, a length in the third direction, between the electric contact surface and one of a pair of opposite end portions of the second lever in the third direction that is farther away from the electric contact surface than a remaining one of the pair of opposite end portions is from the electric contact surface, is a second length, and wherein the second length is greater than the first length.

6. The developing cartridge according to claim 1, wherein the second lever is movable from the fifth position to the sixth position in a case where the developing cartridge is attached to an image forming apparatus.

7. The developing cartridge according to claim 6, wherein, in a case where the developing cartridge is attached to the image forming apparatus, the electric contact surface is out of contact with an electrical connector of the image forming apparatus in a state where the second lever is at the fifth position; and the electric contact surface is in contact with the electrical connector in a state where the second lever is at the sixth position.

8. The developing cartridge according to claim 7, wherein the holder is movable in the second direction relative to the casing in a state where the electric contact surface is in contact with the electric connector.

9. The developing cartridge according to claim 8, wherein one of the casing and the holder has a boss extending in the first direction;

wherein remaining one of the casing and the holder has one of a through-hole and a recessed portion into which the boss is inserted; and wherein the one of the through-hole and the recessed portion has a length in the second direction greater than a length of the boss in the second direction.

10. The developing cartridge according to claim 7, wherein the holder includes an engagement portion configured to engage with the image forming apparatus, and wherein the second lever moves from the fifth position to the sixth position after the engagement portion is brought into engagement with the image forming apparatus.

11. The developing cartridge according to claim 6, wherein the second lever includes a guide surface; and wherein, in a case where the developing cartridge is attached to the image forming apparatus, the second lever moves from the fifth position to the sixth position, with the guide surface being in contact with the image forming apparatus, thereby moving the holder from the first position to the second position.

12. The developing cartridge according to claim 11, wherein the guide surface is positioned at one end portion of the second lever, and wherein the second lever has another end portion connected to the holder.

13. The developing cartridge according to claim 12, wherein the another end portion of the second lever is pivotally movably connected to the holder.

14. The developing cartridge according to claim 1, wherein the holder is movable in the second direction relative to the casing.

15. The developing cartridge according to claim 14, wherein one of the casing and the holder has a boss extending in the first direction;

wherein remaining one of the casing and the holder has one of a through-hole and a recessed portion into which the boss is inserted; and wherein the one of the through-hole and the recessed portion has a length in the second direction greater than a length of the boss in the second direction.

16. The developing cartridge according to claim 14, wherein one of the casing and the first lever has a boss extending in the first direction;

wherein remaining one of the casing and the first lever has one of a through-hole and a recessed portion into which the boss is inserted;

wherein the one of the through-hole and the recessed portion has a length in the second direction greater than a length of the boss in the second direction; and wherein, in a case where the holder moves in the second direction relative to the casing, the first lever moves in the second direction relative to the casing in a state where the boss is inserted into the one of the through-hole and the recessed portion.

17. The developing cartridge according to claim 14, wherein one of the first lever and the second lever has a boss extending in the first direction;

wherein remaining one of the first lever and the second lever has one of a through-hole and a recessed portion into which the boss is inserted;

wherein the one of the through-hole and the recessed portion has a length in the second direction greater than a length of the boss in the second direction; and wherein, in a case where the holder moves in the second direction relative to the casing, the second lever moves relative to the first lever in a state where the boss is inserted into the one of the through-hole and the recessed portion.

18. The developing cartridge according to claim 14, wherein the second lever is pivotally movable about a third axis extending in the first direction, the second lever being pivotally movable from the sixth position to a seventh position that is between the fifth position and the sixth position, wherein the second lever has a guide surface, the guide surface having an arcuate shape whose imaginary center is at the third axis, the guide surface being positioned at one of a pair of opposite end portions of the second lever in the third direction, the one of the pair of opposite end portions being positioned farther away from the electric contact surface than a remaining one of the pair of opposite end portions is from the electric contact surface in each of a case where the second lever is at the sixth position and a case where the second lever is at the seventh position.

19. The developing cartridge according to claim 1, wherein the storage medium is held at the one end portion of the holder in the third direction.

20. The developing cartridge according to claim 1, wherein the first lever is pivotally movable between the third position and the fourth position.

21. The developing cartridge according to claim 1, wherein the second lever is pivotally movable between the fifth position and the sixth position relative to the first lever.

* * * * *